US009791812B2

(12) United States Patent
Shinagawa

(10) Patent No.: US 9,791,812 B2
(45) Date of Patent: Oct. 17, 2017

(54) ROTATABLE FEEDING MEMBER AND ROTATABLE FIXING MEMBER

(71) Applicant: CANON KABUSHIKI KAISHA, Tokyo (JP)

(72) Inventor: Akiyoshi Shinagawa, Kasukabe (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/260,696

(22) Filed: Sep. 9, 2016

(65) Prior Publication Data

US 2017/0090370 A1 Mar. 30, 2017

(30) Foreign Application Priority Data

Sep. 29, 2015 (JP) ..... 2015-191882
Dec. 15, 2015 (JP) ..... 2015-244333

(51) Int. Cl.
*G03G 15/20* (2006.01)

(52) U.S. Cl.
CPC ..... *G03G 15/2057* (2013.01); *G03G 15/206* (2013.01); *G03G 15/2053* (2013.01); *G03G 2215/00679* (2013.01)

(58) Field of Classification Search
CPC ..... G03G 15/2057; G03G 15/2053; G03G 15/206; G03G 2215/00679; G03G 2215/2016; G03G 2215/2048
USPC ..... 399/329, 333
See application file for complete search history.

(56) References Cited

U.S. PATENT DOCUMENTS

| | | | |
|---|---|---|---|
| 5,415,939 | A | 5/1995 | Yeung |
| 6,564,033 | B2 | 5/2003 | Zhou et al. |
| 7,212,776 | B2 | 5/2007 | Takagi et al. |
| 7,376,379 | B2 | 5/2008 | Takahashi et al. |
| 9,134,663 | B2 | 9/2015 | Matsunaka et al. |

FOREIGN PATENT DOCUMENTS

| | | | |
|---|---|---|---|
| JP | 6-64119 | A | 3/1994 |
| JP | 2001-62380 | A | 3/2001 |
| JP | 2002-213432 | A | 7/2002 |
| JP | 2002-258648 | A | 9/2002 |
| JP | 2005-121825 | A | 5/2005 |
| JP | 2005-300915 | A | 10/2005 |
| JP | 2005-338350 | A | 12/2005 |
| JP | 2010-134094 | A | 6/2010 |
| JP | 2014-142611 | A | 8/2014 |
| WO | 2005/054960 | A1 | 6/2005 |

OTHER PUBLICATIONS

European Search Report in European Application No. 16188767.4 (Feb. 17, 2017).

*Primary Examiner* — Sophia S Chen
(74) *Attorney, Agent, or Firm* — Fitzpatrick, Cella, Harper & Scinto

(57) ABSTRACT

A rotatable feeding member for feeding a recording material includes a surface layer formed of a resin material, and a character portion including characters selected from alphabetical and numeral characters made visible by recessing the surface layer, wherein the characters are arranged along a circumferential direction of the rotatable feeding member. The characters are slanted with respect to a longitudinal direction of the rotatable feeding member.

10 Claims, 16 Drawing Sheets

| FONT NAME | NORMAL | ITALIC |
|---|---|---|
| MS P Gothic | 1234567890 | *1234567890* |
| MS P Gothic | 1234567890 | *1234567890* |
| Arial Unicode MS | 1234567890 | *1234567890* |
| HGP Gothic E | 1234567890 | *1234567890* |
| HGP Gothic M | 1234567890 | *1234567890* |
| HGP Kyokashotai | 1234567890 | *1234567890* |
| HGP Gyoshotai | 1234567890 | *1234567890* |
| HGP Soei Presence EB | 1234567890 | *1234567890* |
| HGP Soei Kakugothic UB | 1234567890 | *1234567890* |
| HGP Soei Kakupoptai | 1234567890 | *1234567890* |
| HGP Mincho B | 1234567890 | *1234567890* |
| HGP Mincho E | 1234567890 | *1234567890* |
| HGS Gothic E | 1234567890 | *1234567890* |
| HGS Gothic M | 1234567890 | *1234567890* |
| HGS Kyokasyotai | 1234567890 | *1234567890* |
| HGS Gyoshotai | 1234567890 | *1234567890* |
| HGS Soei Presence EB | 1234567890 | *1234567890* |
| HGS Soei Kakugothic UB | 1234567890 | *1234567890* |
| HGS Soei Kakupoptai | 1234567890 | *1234567890* |
| HGS Mincho B | 1234567890 | *1234567890* |
| HGS Mincho E | 1234567890 | *1234567890* |
| HG Gothic E | 1234567890 | *1234567890* |
| HG Gothic M | 1234567890 | *1234567890* |
| HG Maru Gothic M-PRO | 1234567890 | *1234567890* |
| Kyokashotai | 1234567890 | *1234567890* |
| HG Gyoshotai | 1234567890 | *1234567890* |
| HG Seikaisyotai-PRO | 1234567890 | *1234567890* |
| HG Soei Presence EB | 1234567890 | *1234567890* |
| HG Soei Kakugothic UB | 1234567890 | *1234567890* |
| HG Soei Kakupoptai | 1234567890 | *1234567890* |
| HG Mincho B | 1234567890 | *1234567890* |
| HG Mincho E | 1234567890 | *1234567890* |
| Meiryo UI | 1234567890 | *1234567890* |
| MS P Gothic | 1234567890 | *1234567890* |
| MS P Mincho | 1234567890 | *1234567890* |
| MS UI Gothic | 1234567890 | *1234567890* |
| MS Gothic | 1234567890 | *1234567890* |
| MS Mincho | 1234567890 | *1234567890* |

Fig. 12

ROTATABLE FEEDING MEMBER AND ROTATABLE FIXING MEMBER

FIELD OF THE INVENTION AND RELATED ART

The present invention relates to a rotatable feeding member and rotatable fixing member.

In a fixing device for use with an image forming apparatus, such as a copying machine or a laser printer, of an electrophotographic type, a fixing nip is formed by a pair of rotatable members, such as a roller and a roller, a belt and the roller, or the belt and the belt. Then, a recording material on which a toner image formed of a toner in an unfixed state is carried is introduced into the fixing nip, so that the toner is melted by heating and thus the toner image is fixed on the recording material. As such a rotatable member, a rotatable member having a surface layer which is formed of a fluorine-containing resin material or the like and which has a good parting property has been widely used.

On such a rotatable member, information (production lot number, processing direction, etc.) is displayed by laser marking (process) or the like. The laser marking is effected by irradiating an object surface with a laser beam and then by melting the object surface (Japanese Laid-Open Patent Application (JP-A) Hei 6-64119). Further, a constitution in which an elastic layer which is a layer inside a parting layer is subjected to the laser marking and thereafter the parting layer is formed on a surface of the elastic layer has been proposed (JP-A 2005-338350).

However, in the case where the surface of the rotatable member is subjected to the marking as described in JP-A Hei 6-64119, a portion (recessed portion) subjected to the marking is thinner than another portion, and at the worst, there is a liability that a crack (split) generates on the rotatable member.

SUMMARY OF THE INVENTION

According to an aspect of the present invention, there is provided a rotatable feeding member for feeding a recording material, comprising: a surface layer formed of a resin material; and a character portion including characters selected from alphabetical and numeral characters made visible by recessing said surface layer, wherein the characters are arranged along a circumferential direction of said rotatable feeding member, wherein the characters are slanted with respect to a longitudinal direction of the rotatable feeding member.

According to another aspect of the present invention, there is provided a rotatable fixing member for fixing a toner image on a recording material, comprising: a surface layer formed of a resin material; and a character portion including characters selected from alphabetical and numeral characters made visible by recessing the surface layer, wherein the characters are arranged along a circumferential direction of the rotatable fixing member, wherein the characters are slanted with respect to a longitudinal direction of the rotatable fixing member.

Further features of the present invention will become apparent from the following description of exemplary embodiments with reference to the attached drawings.

BRIEF DESCRIPTION OF THE DRAWINGS

FIG. 12 is an illustration showing examples of fonts usable in second Embodiment.

DESCRIPTION OF THE EMBODIMENTS

First Embodiment

Figure 1:
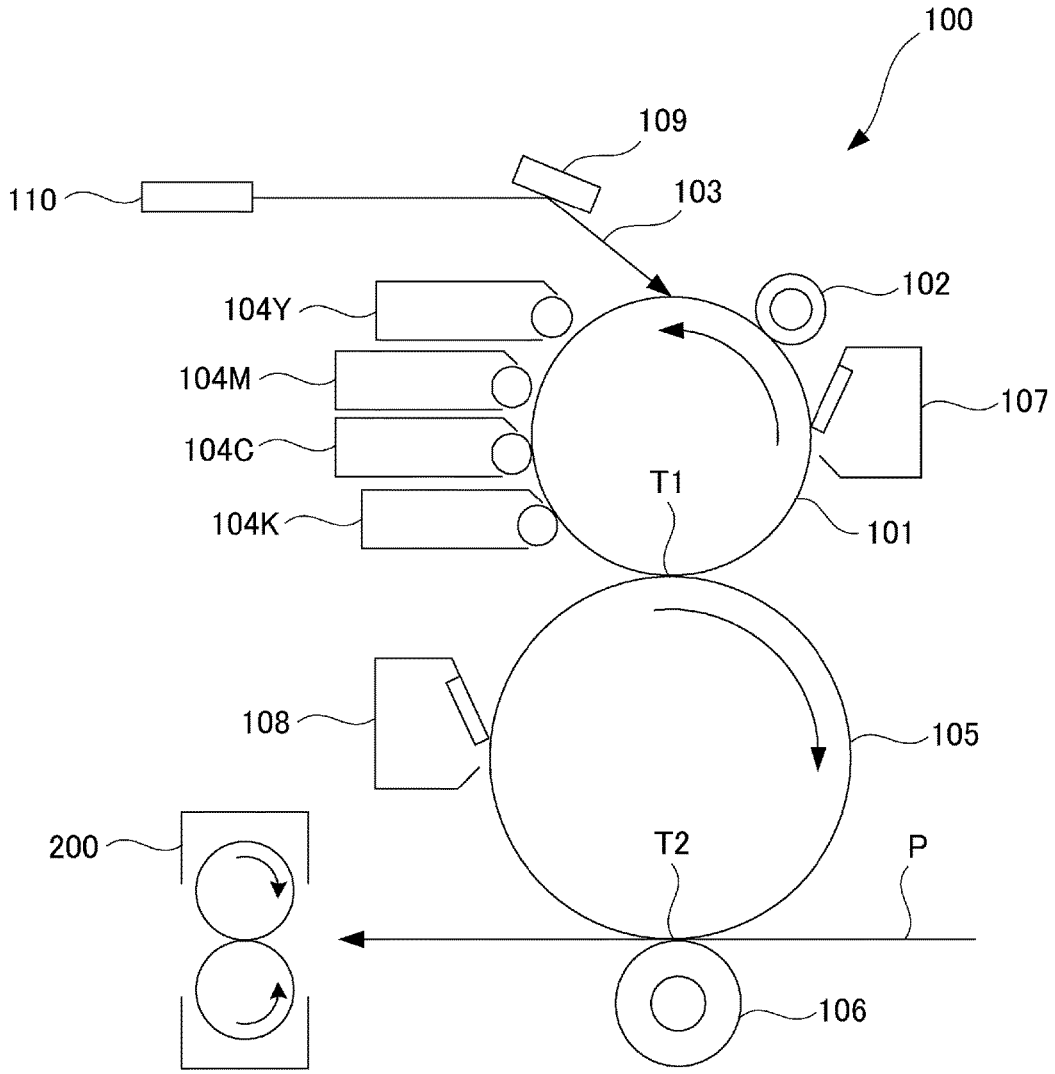
FIG. 1 is a schematic structural view of an image forming apparatus in first Embodiment.

First Embodiment will be described with reference to FIGS. 1 to 10. First, a schematic structure of an image forming apparatus in this embodiment will be described using FIG. 1.

[Image Forming Apparatus]

An image forming apparatus 100 includes a photosensitive drum (photosensitive member) 101 as an image bearing member, and the photosensitive drum 101 is rotationally driven in an arrow direction at a process speed (peripheral speed). The photosensitive drum 101 is electrically charged at a surface thereof to a predetermined potential by a charging roller 102 as a charging device in a rotation process thereof. Then, the charged surface of the photosensitive drum 101 is exposed to laser light 103 outputted from an exposure device 110 constituted by a laser optical system, on the basis of image information inputted. The exposure device 110 outputs the laser light 103 modulated (ON/OFF) correspondingly to a pixel signal corresponding to the image information for an associated color sent from an unshown external terminal such as an image reading device or a personal computer. Then, the surface of the photosensitive drum 101 is subjected to scanning exposure. As a result, by this scanning exposure, an electrostatic latent image corresponding to the image information is formed on the photosensitive drum 101. Incidentally, the laser light 103 outputted from the exposure device 110 is deflected by a deflecting mirror 109 toward an exposure position of the photosensitive drum 101.

Then, the electrostatic latent image formed on the photosensitive drum 101 is visualized as a yellow toner image with a yellow toner by a developing device 104Y. This yellow toner image is transferred onto a surface of an intermediary transfer drum 105 at a primary transfer portion T1 which is a contact portion between the photosensitive drum 1 and the intermediary transfer drum 105. Incidentally, the toner remaining on the surface of the photosensitive drum 101 is removed by a cleaner 107.

A process cycle of charging, exposure, development, primary transfer and a cleaning as described above is similarly repeated also during formation of each of a magenta toner image, a cyan toner image and a black toner image. That is, in the case where the magenta toner image is formed, the electrostatic latent image formed on the photosensitive drum 101 corresponding to magenta is visualized as a magenta toner image with a magenta toner by a developing device 104M. Similarly, a cyan toner image is visualized by a developing device 104C, and a black toner image is visualized by a developing device 104K.

Thus, the respective color toner images successively formed superposedly on the intermediary transfer drum 105 are secondary-transferred altogether onto a recording material (e.g., a sheet material such as a sheet (paper) or an OHP sheet) at a secondary transfer portion T2 which is a contact portion between the intermediary transfer drum 105 and a transfer roller 106. The toner remaining on the intermediary transfer drum 105 is removed by a toner cleaner 108. Incidentally, the toner cleaner 108 is movable toward and away from the intermediary transfer drum 105, and is constituted so that the toner cleaner 108 is in a contact state with the intermediary transfer drum 105 only when the intermediary transfer drum 105 is cleaned. Similarly, also the transfer roller 106 is movable toward and away from the intermediary transfer drum 105, and is constituted so that the transfer roller 106 is in a contact state with the intermediary transfer drum 5 only during the secondary transfer. The recording material P passed through the secondary transfer portion T2 is introduced into a fixing device 200 as a heating device, and unfixed toner images carried on the recording material P are fixed (image-heated). The recording material P subjected to the fixing is discharged to an outside the image forming apparatus, so that a series of image forming operations is ended.

[Fixing Device]

A schematic structure of the fixing device 200 will be described using FIG. 2. The fixing device 200 includes a fixing belt 201 as a heating member, a pressing roller 206 as a nip forming member, and the like. Further, between the fixing belt 201 and the pressing roller 206, a fixing nip N in which the recording material P introduced into the fixing device 200 as described above is nipped and fed is formed. The fixing belt 201 is an endless belt including a silicone rubber elastic layer as specifically described later and is a rotatable member rotatable in contact with the recording material P at its surface (outer surface). Further, the fixing belt 201 is a rotatable fixing member for fixing the toner image formed on the recording material P.

Inside the fixing belt 201, a fixing heater 202, a heater holder 204, a fixing belt stay 205 and the like are provided. The fixing heater 202 is a heating source for not only urging the fixing belt 201 toward the pressing roller 206 but also heating the fixing belt 201, and is constituted by a ceramic heater, for example. For example, the fixing heater 202 includes an alumina substrate and a heat generating resistor which is formed on the alumina substrate by being coated uniformly in a thickness of about 10 μm by screen printing using electroconductive paste containing silver-palladium alloy. Further thereon, glass coating with pressure-resistant glass is made, so that the ceramic heater is prepared. Then, the fixing heater 202 generates heat by being energized.

Such a fixing heater 202 is disposed along a longitudinal direction of the fixing belt 201 (i.e., along the surface of the fixing belt 201 and in a perpendicular direction perpendicular to a rotational direction), and has a constitution in which a heating surface thereof is slidable with an inner surface of the fixing belt 201. Incidentally, onto the inner surface of the fixing belt 201, a semisolid lubricant described later is applied, so that a sliding property between the fixing heater 202 and the heater holder 204 is ensured.

The heater holder 204 is formed of a high heat-resistant material such as a liquid crystal resin material and elongated in the longitudinal direction of the fixing belt 201 and performs a function of not only holding the fixing heater 202 but also shaping the fixing belt 201 for separating the recording material P from the fixing belt 201. That is, the fixing heater 202 is fixed on a surface of the heater holder 204 in a side toward the pressing roller 206. Further, at each of longitudinal end portions of the heater holder 204, a cylindrical supporting portion is provided integral with the heater holder 204 and the heater holder 204 is externally fitted around the cylindrical supporting portion with some degree of freedom. As a result, not only the fixing belt 201 is rotatably supported but also the fixing belt 201 is disposed in a substantially cylindrical shape, so that the recording material P is easily separated by curvature of the fixing belt 201.

The fixing belt stay 205 is disposed along the longitudinal direction of the fixing belt 201 in a side opposite from the fixing heater 202 through the heater holder 204 and is urged at its end portions toward the pressing roller 206 by an unshown pressing (urging) mechanism. For example, the fixing belt stay 205 is urged toward the pressing roller 206 with a force of 156.8 N (16 kgf) in one side thereof, i.e., with a total pressure of 313.6 N (32 kgf). Thus, the heating surface of the fixing heater 202 is press-contacted to the fixing belt 201 toward the pressing roller 206 described later with a predetermined urging force by the unshown pressing mechanism through the heater holder 204. As a result, the pressing roller 206 is elastically deformed, so that the fixing nip N which is required for the fixing and which has a predetermined width is formed between the fixing belt 201 and the pressing roller 206.

The pressing roller 206 is an elastic roller having a multi-layer structure in which on a core metal, e.g., an about 3 mm-thick silicone rubber elastic layer and, e.g., an about 40 μm-thick PFA resin tube are laminated in the listed order. Incidentally, PFA is a tetrafluoroethylene-perfluoro (alkylvinyl ether) copolymer. The pressing roller 206 is disposed so that its rotational axis direction (longitudinal direction) is substantially parallel to the longitudinal direction of the fixing belt 201, and longitudinal end portions of the core metal are rotatably shaft-supported and held between unshown side plates of a frame 13 of the fixing device 200 in a front side and a rear side of the side plates. Further, the pressing roller 206 is rotationally driven in an arrow direction at a predetermined peripheral speed by an unshown motor which is a driving source. The fixing belt 201 in a press-contact relationship with the pressing roller 206 is rotated at a predetermined speed by the pressing roller 206. At this time, the fixing belt 201 is rotated in an arrow direction by the pressing roller 206 by being guided by the heater holder 204 while being slid with the heating surface of the fixing heater 202 at its inner surface.

Further, on a back surface (opposite from the heating surface) of the fixing heater 202, a thermistor 203 is provided and detects a temperature of the fixing heater 202. The thermistor 203 is disposed so as to contact the back surface of the fixing heater 202 and is connected with a control circuit portion (CPU) 210 as a control means through an A/D converter 209.

This control circuit portion 210 effects sampling of an output from the thermistor 203 at a predetermined period, and the thus-obtained temperature information is reflected in temperature control of the fixing heater 202. That is, the control circuit portion 210 determines the contents of the temperature control of the fixing heater 202 on the basis of the output of the thermistor 203. Further, by a heater drive circuit portion 211, energization to the fixing heater 202 is controlled so that the temperature of the fixing heater 202 reaches a target temperature (set temperature). Further, the control circuit portion 210 is connected with a motor for driving the pressing roller 206 through the A/D converter 209, and thus controls also drive of the pressing roller 206.

The thus-constituted fixing device 200 forms the fixing nip N between the fixing belt 201 and the pressing roller 206 as described above. As shown in FIG. 2, when the recording material P on which a toner image t is placed is fed in an arrow direction, the recording material P is guided to the fixing nip N by a feeding guide 207. Then, when the recording material P is nipped and fed through the fixing nip N, a surface of the recording material P where the toner image t is placed contacts the fixing belt 201 and is heated and pressed, so that the toner image t is fixed on the recording material P. Thereafter, the recording material P is fed to an outside of the fixing device 200 by a discharging roller 208.

[Structure of Fixing Belt]

Figure 3:
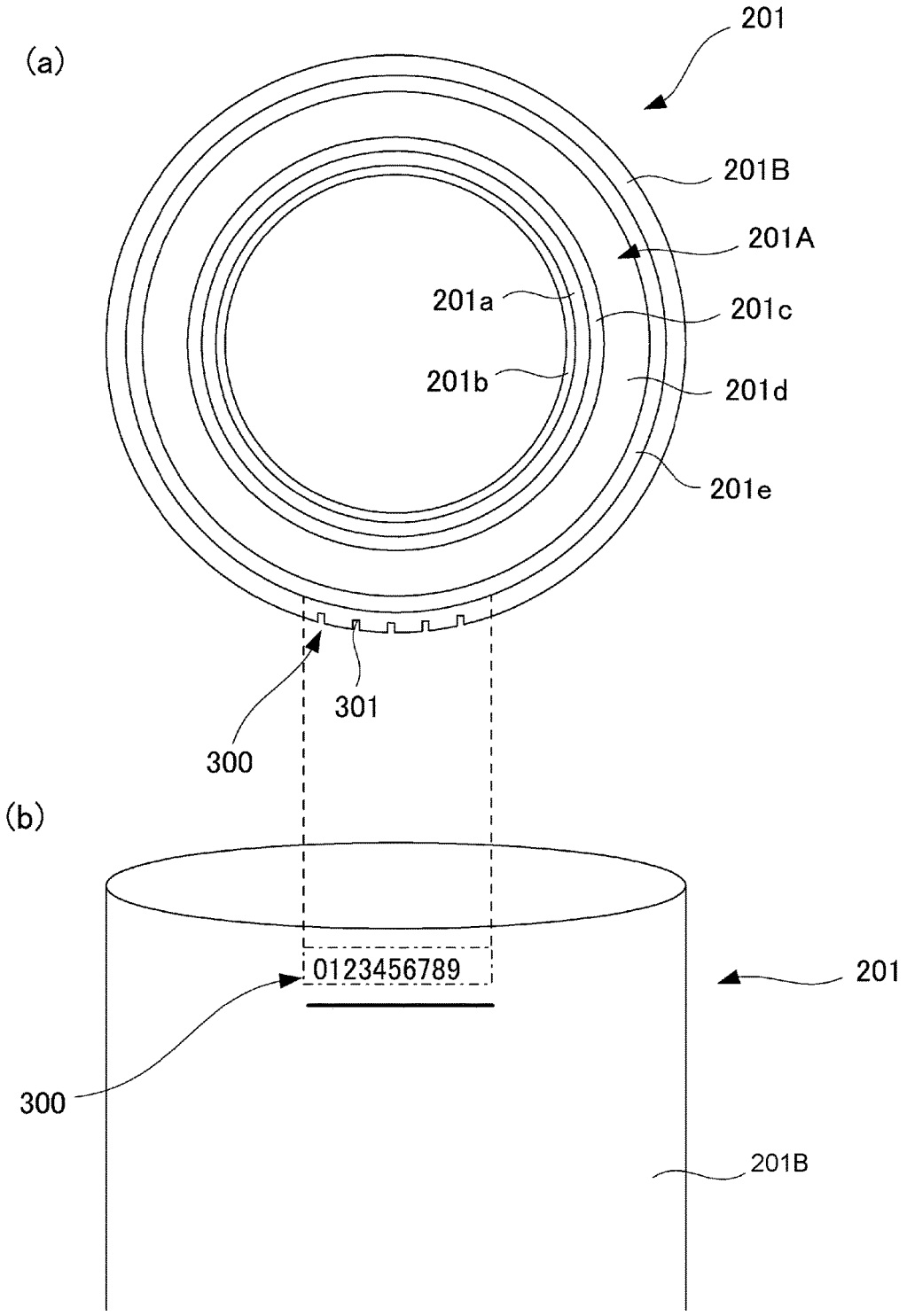
FIG. 3, (a) is a schematic sectional view of a fixing belt in first Embodiment, and (b) is an enlarged schematic view of an end portion of the fixing belt.

Next, a structure of the fixing belt 201 will be described specifically using FIG. 3. As shown in (a) of FIG. 3, the fixing belt 201 includes a base portion 201A and a surface layer (parting layer) 201B provided on a surface (outer peripheral surface) of the base portion 201A. The base portion 201A is constituted by a substrate 201*a* formed in an endless shape, a sliding (slidable) layer 201*b*, a primer layer 201*c*, an elastic layer 201*d* and an adhesive layer 201*e*. The sliding layer 201*b* is formed on an inner surface of the substrate 201*a*. Here, the sliding layer 201*b* is provided for improving a sliding property with the fixing heater 202 as an urging member, and in the case where there is no need to particularly improve the sliding property, the sliding layer 201*b* may also be omitted. The elastic layer 201*d* is an elastic layer formed of a silicone rubber coated over an outer peripheral surface of the substrate 201*a* through the primer layer 201*c*.

The surface layer 201B is a parting layer (fluorine-containing resin layer) formed of a resin material (fluorine-containing resin material, and is provided over an outer peripheral surface of the elastic layer 201*d* through the adhesive layer 201*e*. In the case of this embodiment, as shown in (b) of FIG. 3, on a surface of the surface layer 201B corresponding to a non-image range of an end portion of the fixing belt 201, information 300 is formed by laser marking (process). The information 300 is displayed by melting a part of the surface layer 201B by heat of a laser and thus by forming recesses and projections on the surface of the surface layer 201B. For this reason, as shown in (a) of FIG. 3 in an exaggerated manner, at a portion of the information 300 on the surface of the surface layer 201B, a recessed portion 301 corresponding to the information 300 is formed. In an example of the illustration in (b) of FIG. 2, numerical information is shown, but other than the numerical information, another information of a character such as an alphabet, a figure, or the like is shown singly or in combination in some cases. As such information, it is possible to cite, e.g., a production date, a production lot number, a direction of processing, and so on.

Figure 4:
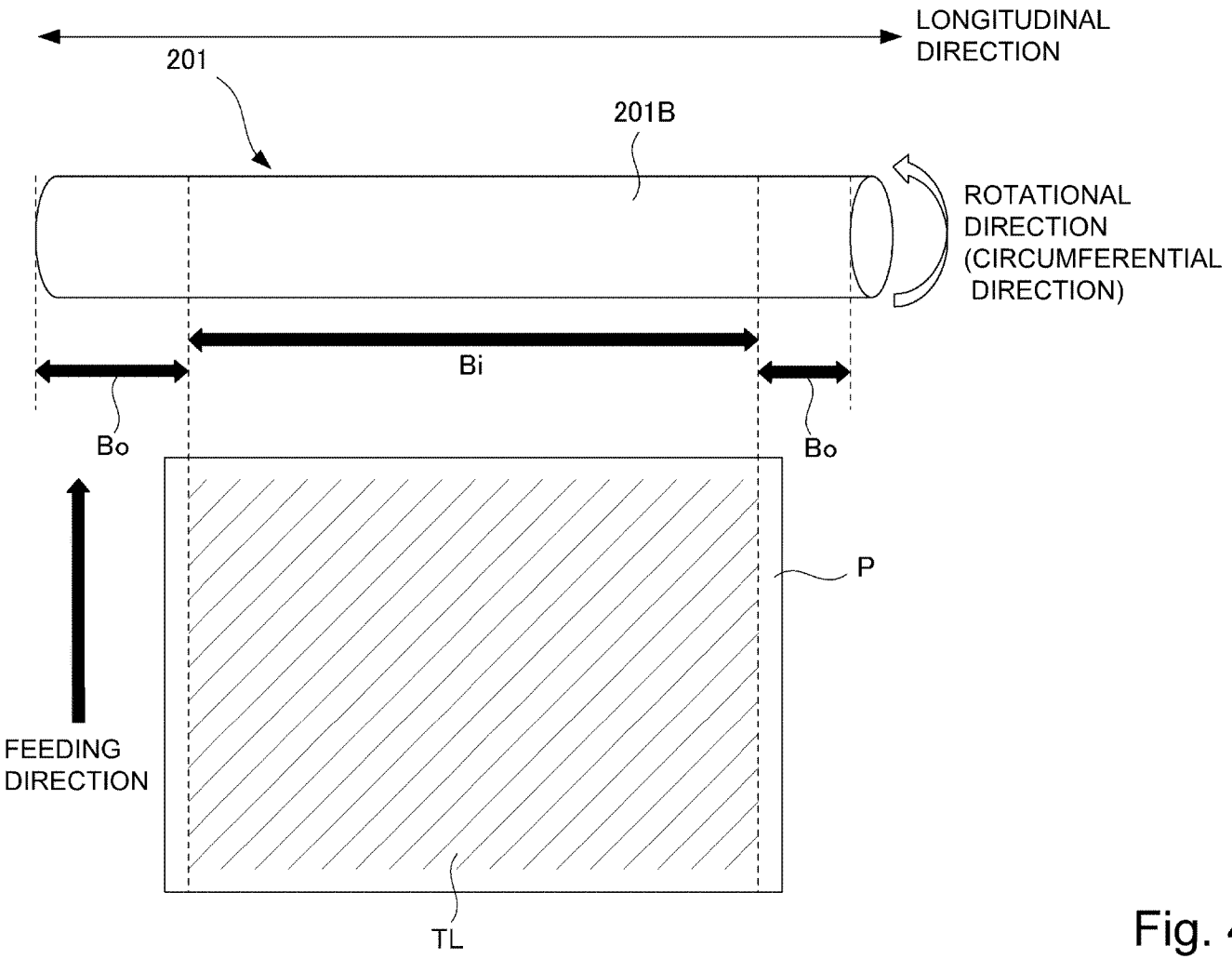
FIG. 4 is a schematic view for illustrating a non-image range of the fixing belt.

Here, the non-image range of the fixing belt 201 will be described using FIG. 4. First, a region where the toner image is formable in the case where a margin of a maximum-width recording material P on which the image is formable by the image forming apparatus is minimized is a maximum region TL. Incidentally, the width of the recording material P is a width with respect to the longitudinal direction of the fixing belt 201. Further, in the case where a range of the fixing belt 201 corresponding to this maximum region (image formation region) is an image range Bi, a range out of the image range Bi is a non-image range Bo. In other words, the non-image range Bo is a range, of the surface (range) of the fixing belt 201, in which the toner image does not contact the fixing belt 201 even when the toner image is formed in an entirety of the maximum region TL of the maximum-width recording material is formed and the recording material is introduced into the fixing device 200. That is, of the surface (range) of the surface layer 201B, the non-image range is a range deviated from the image, formed in the maximum region of the maximum-sized recording material capable of contacting the surface of the surface layer 201B, toward an end portion side with respect to a perpendicular direction (longitudinal direction) perpendicular to the rotational direction of the fixing belt 201. In this embodiment, the non-image range Bo exists at each of the longitudinal end portions of the fixing belt 201. Further, on the surface of the surface layer 201B, within a range of the non-image range Bo, the recessed portion 301 for displaying the above-described information is formed.

Next, of the above-described fixing belt 201, the substrate 201*a*, the sliding layer 201*b*, the elastic layer 201*d*, the adhesive layer 201*e* and the surface layer 201B will be specifically described.

[Substrate]

The substrate 201*a* may preferably be a metal substrate or a heat-resistant resin substrate in consideration of a heat-resistant property and a flex-resistance property since the heat-resistant property is required for the fixing belt 201. For example, as the metal substrate, an electroplated nickel substrate and the like as described in JP-A 2002-258648, International Publication No. WO 2005/054960, JP-A 2005-121825 and the like can be used. As the heat-resistant resin substrate, it is possible to use substrates of polyimide resin, polyamideimide resin, polyether ether ketone resin and the like as described in JP-A 2005-300915, JP-A 2010-134094 and the like. In this embodiment, an endless substrate, as described in WO 2005/054960, formed of a nickel-iron alloy in an inner diameter of 30 mm, a thickness of 40 μm and a length of 400 mm was used.

[Sliding Layer]

As a material of the sliding layer 201*b*, a resin material having a high durability and a high heat-resistant property, such as the polyimide resin, the polyamideimide resin or the polyether ether ketone resin is suitable. Particularly, from the viewpoints of ease of manufacturing, heat-resistant property, elastic modulus, strength and the like, the polyimide resin material may preferably be used. In the case where the sliding layer 201*b* is formed of the polyimide resin material, the sliding layer 201*b* is formed in the following manner, for example. A polyimide precursor solution obtained by reaction of aromatic tetracarboxylic dianhydride or its derivative with aromatic diamine in the substantially same molar ratio in an organic polar solvent is applied (coated) onto an inner surface of the above-described substrate 201*a*, followed by drying, heating and dewatering cyclization reaction. As a result, it is possible to form the sliding layer 201*b* with the polyimide resin material on the inner surface of the substrate 201*a*.

Specifically, as a coating method, e.g., a method such as a ring coating is usable, and after the coating, the substrate 201*a* coated at its inner surface is left standing and dried for 30 min. in a circulating hot air oven at 60° C., for example. Thereafter, the substrate 201*a* is left standing and baked for 10-60 min. in the circulating hot air oven at 200° C.-240° C. which is a temperature range in which fatigue strength of the substrate 201*a* is not lowered, so that the sliding layer 201*b* of the polyimide resin material can be formed by the dewatering cyclization reaction.

[Elastic Layer]

The elastic layer 201*d* does not crush the toner more than necessary when the toner image is fixed on the recording material in the fixing nip N, and functions as a layer for imparting, to the fixing belt 201, an elastic property such that the fixing belt 201 has flexibility following unevenness of fibers of paper in the case where the recording material is the paper. Further, as a function of the fixing belt 201, it is also required that a heat quantity enough to melt the toner is supplied to the recording material in a short time at the fixing nip N. Heat supplying power of the fixing belt 201 can be improved by creating design so that heat permeability ($b=(\lambda\times Cp\times\rho)^{0.5}$ of the elastic layer, i.e., thermal conductivity and volume thermal capacity of the elastic layer are high as described in JP-A 2014-142611. As the elastic layer exhibiting the flexibility and the heat supplying power as described above, as described in JP-A 2014-142611, a silicone rubber elastic layer prepared by mixing carbon fibers and an inorganic filler in an addition-curable silicone rubber as a base material and then by curing the mixture has been known.

The addition-curable silicone rubber as the base material generally contains an organopolysiloxane having an unsaturated aliphatic group, an organopolysiloxane having an active hydrogen bonded to silicon, and a platinum compound as a crosslinking catalyst. The organopolysiloxane having the active hydrogen bonded to silicon forms a crosslinked structure by reaction thereof with an alkenyl group of the organopolysiloxane component having the unsaturated aliphatic group by means of catalysis of the platinum compound.

The carbon fibers and the inorganic filler are mixed while achieving a balance among the thermal conductivity, the thermal capacity, the flexibility and the like. In general, with an increasing amount of the inorganic filler mixed, although the thermal conductivity and the thermal capacity and improved, there is a tendency that the flexibility lowers. For this reason, a heat conduction path is formed among particles of the inorganic filler by the carbon fibers so as not to lose the flexibility. As a result, a ratio of an amount of the base material to a total amount of the carbon fibers and the inorganic filler can be increased, and therefore it is possible to achieve the balance of the thermal conductivity and the thermal capacity with the flexibility. As an example of the carbon fibers, it is possible to cite carbon fibers and a carbon nanotube.

As an example of the inorganic filler, it is possible to cite silicon carbide (SiC), silicon nitride ($Si_3N_4$), boron nitride (BN), aluminum nitride (AlN), alumina ($Al_2O_3$), zinc oxide (ZnO), magnesium oxide (MgO), silica ($SiO_2$), copper (Cu), aluminum (Al), silver (Ag), iron (Fe), nickel (Ni), and the like.

The inorganic filler can be used singly or in mixture of two or more species. An average particle size of the inorganic filler may preferably be 1 μm or more and 50 μm or less from the viewpoints of handling and dispersibility. Further, as a shape of the inorganic filler, a spherical shape, a pulverized shape, a plate shape, a whisker shape are used, but the spherical shape may preferably be used from the viewpoint of the dispersibility.

From the viewpoints of contribution to surface hardness of the fixing belt and efficiency of heat conduction to the unfixed toner during the fixing, a thickness of the elastic layer 201*d* may preferably be in a range of 100 μm or more and 500 μm or less, particularly in a range of 200 μm or more and 400 μm or less.

As a processing method of the elastic layer 201*d*, processing methods, such as metallic molding, blade coating, nozzle coating and ring coating have been widely known in JP-A 2001-62380, JP-A 2002-213432, and the like.

Figure 5:
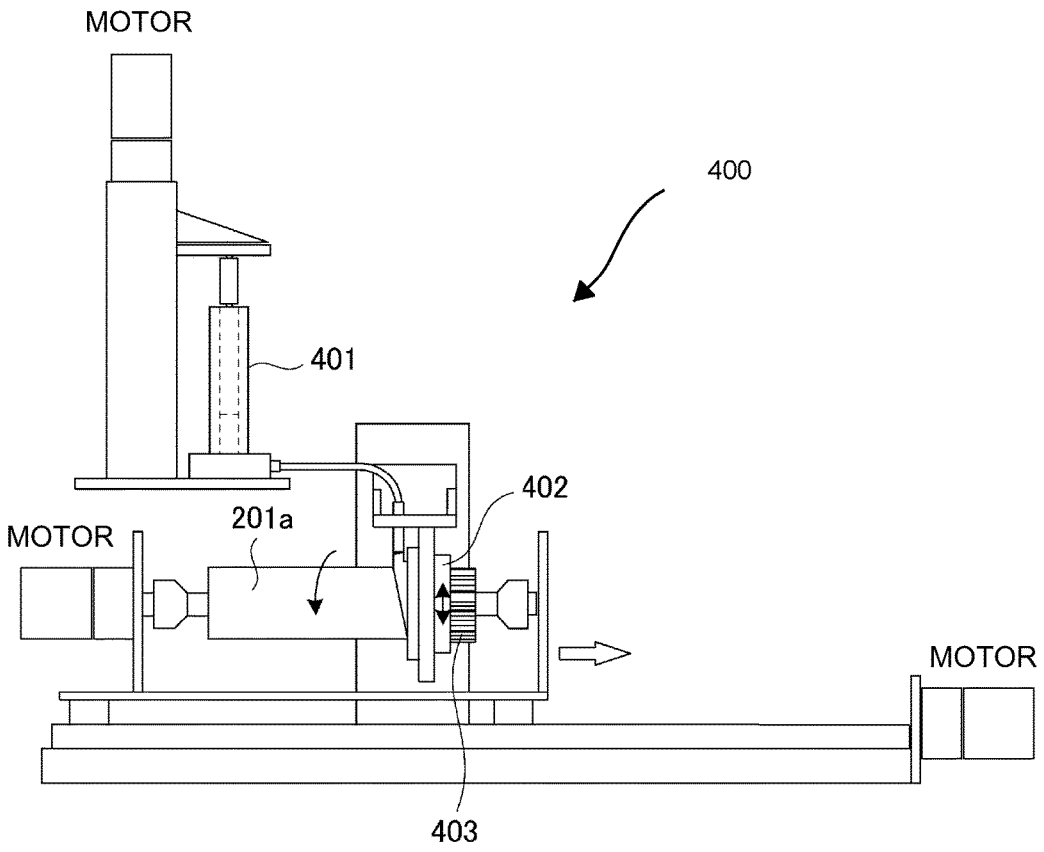
FIG. 5 is a schematic view showing a coating device using a ring coating method.

FIG. 5 shows an example of a step of forming the silicone rubber elastic layer 201*d* on the substrate 201*a*, and is a schematic view of a coating device 400 for illustrating a so-called ring coating (method). An addition-curable silicone rubber composition in which an addition-curable silicone rubber and a filler are mixed is filled in a cylinder pump 401 and then is pressure-fed, so that the composition is coated (applied) onto a peripheral surface of the substrate 201*a* through a coating liquid supplying nozzle (not shown) provided inside a coating head 402. Here, the substrate 201*a* is formed integrally with a cylindrical core metal inserted therein. By moving the substrate 201*a* in a right-hand direction in the figure at a certain speed simultaneously with the coating of the addition-curable silicone rubber composition, a coating layer of the addition-curable silicone rubber composition is formed on the peripheral surface of the substrate 201*a*.

A thickness of the coating layer can be controlled depending on a clearance between the coating liquid supplying nozzle and the substrate 201*a*, a supplying speed of the silicone rubber composition, a moving speed of the substrate 201*a*, and the like. In this embodiment, a 300 μm-thick silicone rubber composition layer 403 was obtained under a condition of 400 μm in clearance between the coating liquid supplying nozzle and the substrate 201*a*, 2.8 mm/s in supplying speed of the silicone rubber composition and 30 mm/s in moving speed of the substrate 201*a*. The addition-curable silicone rubber composition layer 403 formed on the substrate 201*a* is heated for a certain time by a heating device such as an electric furnace, so that cross-linking reaction is progressed and thus the silicone rubber elastic layer 201*d* can be formed.

In order to improve an adhesive property between the substrate 201*a* and the elastic layer 201*d*, the substrate 201*a* may desirably be subjected to primer treatment (process) in advance, and in this embodiment, the primer layer 201*c* is formed on the substrate 201*a*. The primer layer 201*c* is required to have good wettability with the substrate 201*a* compared with the silicone rubber elastic layer 201*d*. As such a printer, it is possible to cite a hydroxyl-based (SiH-based) silicone primer, a vinyl-based silicone primer, an alkoxy-based silicone primer, and the like, for example. A thickness of the primer layer 201*c* may preferably be an amount to the extent that an adhesive performance is achieved while reducing a degree of non-uniformity, and may desirably be about 0.5-5.0 μm.

[Adhesive Layer]

The adhesive layer 201*e* is formed by fixing a fluorine-containing resin tube on the cured silicone rubber elastic layer as the elastic layer 201*d*. Such an adhesive layer 201*e* consists of a cured product of an addition-curable silicone rubber adhesive uniformly coated in a thickness of 1-10 μm on the surface of the elastic layer 201*d*. The addition-curable silicone rubber adhesive contains a addition-curable silicone rubber in which a self-adhesive component is mixed.

Specifically, the addition-curable silicone rubber adhesive contains organopolysiloxane having an unsaturated hydrocarbon group represented by a vinyl group, hydrogenorganopolysiloxane, and a platinum compound as a cross-linking catalyst. Then, the addition-curable silicone rubber adhesive is cured by addition reaction. As such an adhesive, it is possible to use a known adhesive. For example, as the adhesive, it is possible to use an addition-curable silicone rubber adhesive ("DOW CORNING (R) SE 1819 CV A/B", manufactured by Dow Corning Toray Co., Ltd.),

[Surface Layer]

The surface layer 201B is formed using a layer of the following resin material molded in a tube shape, for example. The resin material is a tetrafluoroethylene-perfluoro(alkylvinyl ether) copolymer (PFA), polytetrafluoroethylene (PTFE), a tetrafluoroethylene-hexafluoropropylene copolymer (FEP), or the like.

Further, in the surface layer 201B, an electroconductive member (material) such as carbon (e.g., carbon black, carbon nanotube) is mixed. A carbon mixing ratio per unit weight may desirably be 5 wt. % or more and 10 wt. % or less. In this embodiment, the carbon mixing ratio in the surface layer 201B is 8 wt. %. This is because the surface layer 201B is grounded so that the recording material and the toner are not electrically attracted to the fixing belt 201. For this reason, the surface layer 201B is non-transparent (specifically, a light transmittance of 50% or less, exactly 10% or less). In the case of this embodiment, the surface layer 201B has a surface resistivity of $10^{12}$ Ω/square or less.

As the resin material forming the surface layer 201B, from the above-listed resin materials, PFA is preferred from the viewpoints of a molding property and a toner parting property. In this embodiment, as the surface layer 201B, a 40 μm-thick PFA tube was used. A thickness of the surface layer 201B may preferably be 10 μm or more and 50 μm or less. This is because when the surface layer 201B is laminated on the silicone rubber elastic layer 201*d* as a lower layer, elasticity of the silicone rubber elastic layer 201*d* is maintained and thus it is possible to suppress an excessive increase in surface hardness of the resultant fixing belt 201. An inner surface of the fluorine-containing resin tube is subjected to sodium treatment, excimer laser treatment, ammonia treatment or the like in advance, so that the adhesive property can be improved. The fluorine-containing resin tube in this embodiment was molded by extruding a melted PFA pellet from a cylindrical die and then by being molded as a seamless tube with respect to a circumferential direction.

Then, on the surface of the above-described elastic layer 201*d*, the above-described addition-curable silicone rubber adhesive is coated, and on the surface of the thus-formed adhesive layer 201*e*, the fluorine-containing resin tube is coated and laminated. A coating method is not particularly limited, but it is possible to use a method in which the addition-curable silicone rubber adhesive is coated as a lubricant, a method in which the fluorine-containing resin tube is externally expanded and coated (expansion coating method), and the like method. In this embodiment, the expansion coating method was used.

Figure 6:
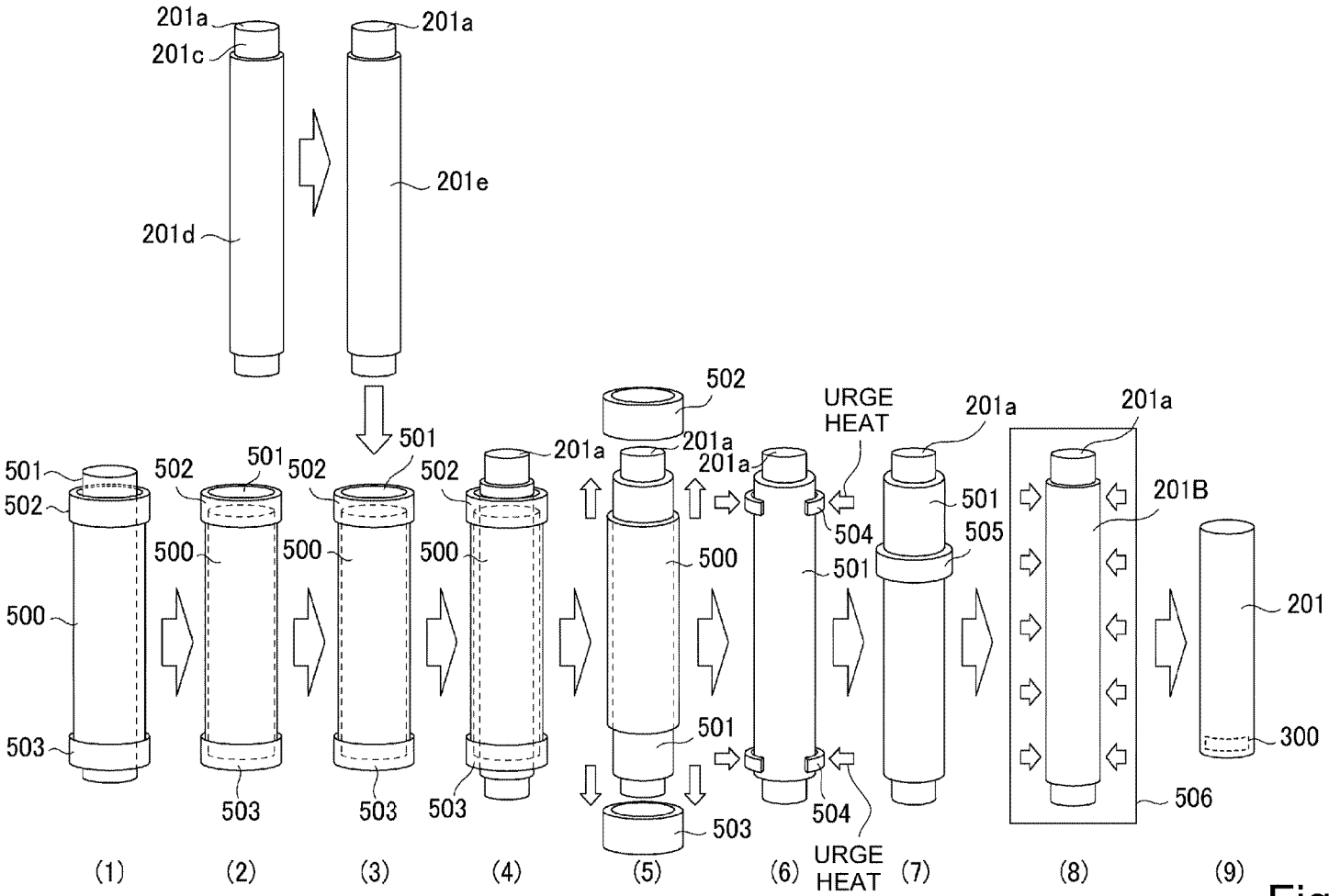
FIG. 6 is a schematic view showing a fixing belt forming process (step).

FIG. 6 is a schematic view sequentially showing steps (1) to (9) starting from a step of coating the fluorine-containing resin tube as the surface layer 201B over the substrate 201*a* on which the elastic layer 201*d* is laminated. In the expansion coating method, the substrate 201*a* on which the elastic layer 201*d* is laminated is set on a core (not shown), and a fluorine-containing resin tube 501 is disposed on an inner surface of a tube expansion die (mold) 500. In the following, a manufacturing method of the fixing belt 201 in this embodiment will be specifically described.

As shown in the step (1) at a left end portion of FIG. 6, inside the tube expansion die 500 formed of metal and having an inner diameter larger than an outer diameter of the substrate 201*a* on which the elastic layer 201*d*, the fluorine-containing resin tube 501 is disposed. Then, the fluorine-containing resin tube 501 is held at both end portions by holding members 502 and 503.

Then, as shown in the step (2), a gap portion between an outer surface of the fluorine-containing resin tube 501 an inner surface of the tube expansion die 500 is placed in a vacuum state (negative pressure relative to ambient pressure. In the vacuum state (5 kPa), the fluorine-containing resin tube 501 is expanded (increased in diameter), so that the outer surface of the fluorine-containing resin tube 501 and the inner surface of the tube expansion die 500 are closely contacted to each other.

Then, as shown in the step (3), into the expanded fluorine-containing resin tube 501, the substrate 201*a* on which the elastic layer 201*d* is laminated is inserted. As shown at an upper portion of FIG. 6, onto the surface of the elastic layer 201*d*, the addition-curable silicone rubber adhesive constituting the adhesive layer 201*e* is uniformly applied (coated) in advance. Incidentally, the inner diameter of the tube expansion die 500 is not particularly limited when the insertion of the substrate 201*a* into the fluorine-containing resin tube 501 is smoothly performed.

Then, as shown in the step (4), after the substrate 201*a* is disposed inside the expanded fluorine-containing resin tube 501, the vacuum state of the gap portion between the outer surface of the fluorine-containing resin tube 501 and the inner surface of the tube expansion die 500 is eliminated (i.e., the negative pressure relative to the ambient pressure is eliminated). By eliminating the vacuum state, the increased diameter of the fluorine-containing resin tube 501 is decreased to the same diameter as the outer diameter of the substrate 201*a* on which the elastic layer 201*d* is laminated, so that the inner surface of the fluorine-containing resin tube 501 and the outer surface of the elastic layer 201*d* (exactly the adhesive layer 201*e*) are in a closely contacted state.

Then, as shown in the step (5), the holding members 502 and 503 are demounted from the end portions of the fluorine-containing resin tube 501, and the fluorine-containing resin tube 501 is elongated to a predetermined elongation ratio in the longitudinal direction. When the fluorine-containing resin tube 501 is elongated, the addition-curable silicone rubber adhesive between the fluorine-containing resin tube 501 and the elastic layer 201*d* performs a function of a lubricant, so that the fluorine-containing resin tube 501 can be smoothly elongated.

In this embodiment, the elongation ratio of the fluorine-containing resin tube 501 in the longitudinal direction was 8% on the basis of a full length of the fluorine-containing resin tube 501 in the coated state on the elastic layer 201*d* as described in the above-described step (4). By elongating the fluorine-containing resin tube 501 in the longitudinal direction, creases do not readily generate on the fluorine-containing resin tube 501, so that the fixing belt excellent in durability can be obtained.

Then, as shown in the step (6), the tube expansion die 500 is demounted, and in order to maintain the elongated state of the fluorine-containing resin tube 501, the fluorine-containing resin tube 501 is temporarily fixed by being urged and heated by a metal block 504 with a built-in heater from an outside thereof at each of portions close to longitudinal ends thereof. That is, the fluorine-containing resin tube 501 is elongated in the longitudinal direction by 8% and coats the substrate 201*a* on which the elastic layer 201*d* is laminated, and therefore, a force for returning the length of the fluorine-containing resin tube 501 to the original length acts on the fluorine-containing resin tube 501. Therefore, the fluorine-containing resin tube 501 is urged (pressed) and heated by the metal block 504 or the like, and thus is temporarily fixed in the elongated state. During the urging and the heating, a temperature of the metal block 504 was 200° C. and an urging and heating time was 20 sec.

Then, as shown in the step (7), the fluorine-containing resin tube 501 is squeezed by a squeezing member 505, so that an excessive addition-curable silicone rubber adhesive is squeezed out of the gap between the elastic layer 201*d* and the fluorine-containing resin tube 501 and thus is removed.

Then, as shown in the step (8), as described above, the substrate 201*a* coated with the fluorine-containing resin tube 501 is heated for a predetermined time in an electric furnace 506. As a result, the addition-curable silicone rubber adhesive is cured to form the adhesive layer 201*e*, so that on the substrate 201, the elastic layer 201*d* and the surface layer 201B are laminated. That is, onto the surface of the base portion 201A constituted by the substrate 201*a*, the sliding layer 201*b*, the primer layer 201*c*, the elastic layer 201*d* and the adhesive layer 201*e*, the fluorine-containing resin tube 501 is bonded, so that the surface layer 201B is formed on the base portion 201A (first step).

Then, as shown in the step (9), the longitudinal end portions of the substrate 201*a* on which the elastic layer 201*d* and the surface layer 201B are laminated are cut in a desired length, and then is subjected to laser marking (process) in the above-described non-image range, so that the information 300 is displayed and thus the fixing belt 201 is prepared. That is, in the non-image range of the surface of the surface layer 201B, the recessed portion 301, as described below, for displaying the information 300 is formed (second step).

[Laser Marking (Process)]

Then, the laser marking for displaying the information 300 on the fixing belt 201 as described above will be explained. As described above, in order to impart (mark) the information 300 such as the production lot number or the orientation direction, the surface of the surface layer 201B of the fixing belt 201 is subjected to the laser marking. The laser marking is excellent in productivity since in the laser marking, there is no need to exchange consumable parts due to abrasion and deterioration compared with the case of marking by a cutter or the like. Further, the laser marking is made in a non-contact manner and therefore a processing material is not readily deformed by stress and pressure during the processing. For this reason, even when the silicone rubber is used for forming the surface layer 201B, good processing accuracy is obtained.

As the laser used for the marking, it is possible to use a known laser such as a YAG laser, a $YAVO_4$ laser or a $CO_2$ laser. In this embodiment, as a laser marker, a $CO_2$ laser marker ("ML-G9300", manufactured by KEYENCE Corp.) was used. In this embodiment, the surface of the surface layer 201B was irradiated continuously with a $CO_2$ laser beam of 10.6 μm in wavelength under a condition of 4 W in output and 25 kHz in oscillating frequency, so that the recessed portion 201 ((a) of FIG. 3) was formed. By the recessed portion 301, the information 300 such as a character or a figure is displayed. For example, the information 300 is the character made visible by the recessed portion 301 formed on the surface layer 201B and is a character portion where characters selected from alphabetical and numeral characters are arranged along a circumferential direction of the fixing belt 201.

In this embodiment, as a font used for displaying the information 300, a KEYENCE original font (standard) was used. Although details will be specifically described later, another font may also be used. It is preferable that a width and a height of the font is 1 mm or more and 10 mm or less. In this embodiment, a font size was 3×3 mm.

A depth of the recessed portion 301 may desirably be deep when viewability is taken into consideration, but may preferably be shallow from the viewpoint of the strength of the surface layer 201B. For that reason, when the strength of the surface layer 201B is taken into consideration, the depth of the recessed portion 301 may desirably be 50% or less of the thickness of the surface layer 201B. Or, the thickness of the surface layer 201B at the recessed portion 301 may preferably be constituted so as to be at least 10 μm (10 μm or more). When the viewability is taken into consideration, the depth of the recessed portion 301 may desirably be 10% or more of the thickness of the surface layer 201B. Or, the depth of the recessed portion 301 may desirably be at least 5 μm (5 μm or more), more desirably be 8 μm or more and 15 μm or less. In this embodiment, the depth of the recessed portion 301 was 10 μm. Further, a line width of the recessed portion 301 in this embodiment is 100 μm. When the viewability is taken into consideration, the line width may desirably be 10 μm or more and 200 μm or less.

[Orientation Property of Fluorine-Containing Resin Tube]

Figure 7:
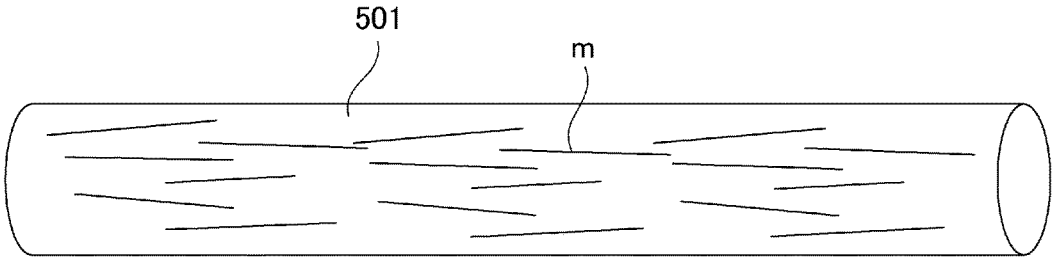
FIG. 7 is a schematic view showing an orientation direction of a fluorine-containing resin tube molded by an extruding system.

Here, an orientation property of the fluorine-containing resin tube constituting the surface layer 201B on which the information 300 is formed as described above. As described above, the fluorine-containing resin tube is molded by extruding the melted PFA pellet from the cylindrical die into a seamless tube with respect to the circumferential direction. When the fluorine-containing resin tube 501 is molded by such a method, as shown in FIG. 7, there is a tendency that a main chain m of the PFA resin material is oriented in an extrusion direction. This extrusion direction is the longitudinal direction of the fixing belt 201. When a degree of orientation in the extrusion direction is 50 or more and 100 or less, the surface layer 201B is liable to split in the longitudinal direction. For this reason, the surface layer 201B formed by the extrusion molding is liable to split in the extrusion direction, i.e., the longitudinal direction. Incidentally, the fluorine-containing resin tube in this embodiment is not transparent, and therefore it is difficult to directly check the degree of orientation. However, it is possible to estimate the degree of orientation from an extrusion speed during the extrusion molding.

Figure 8:
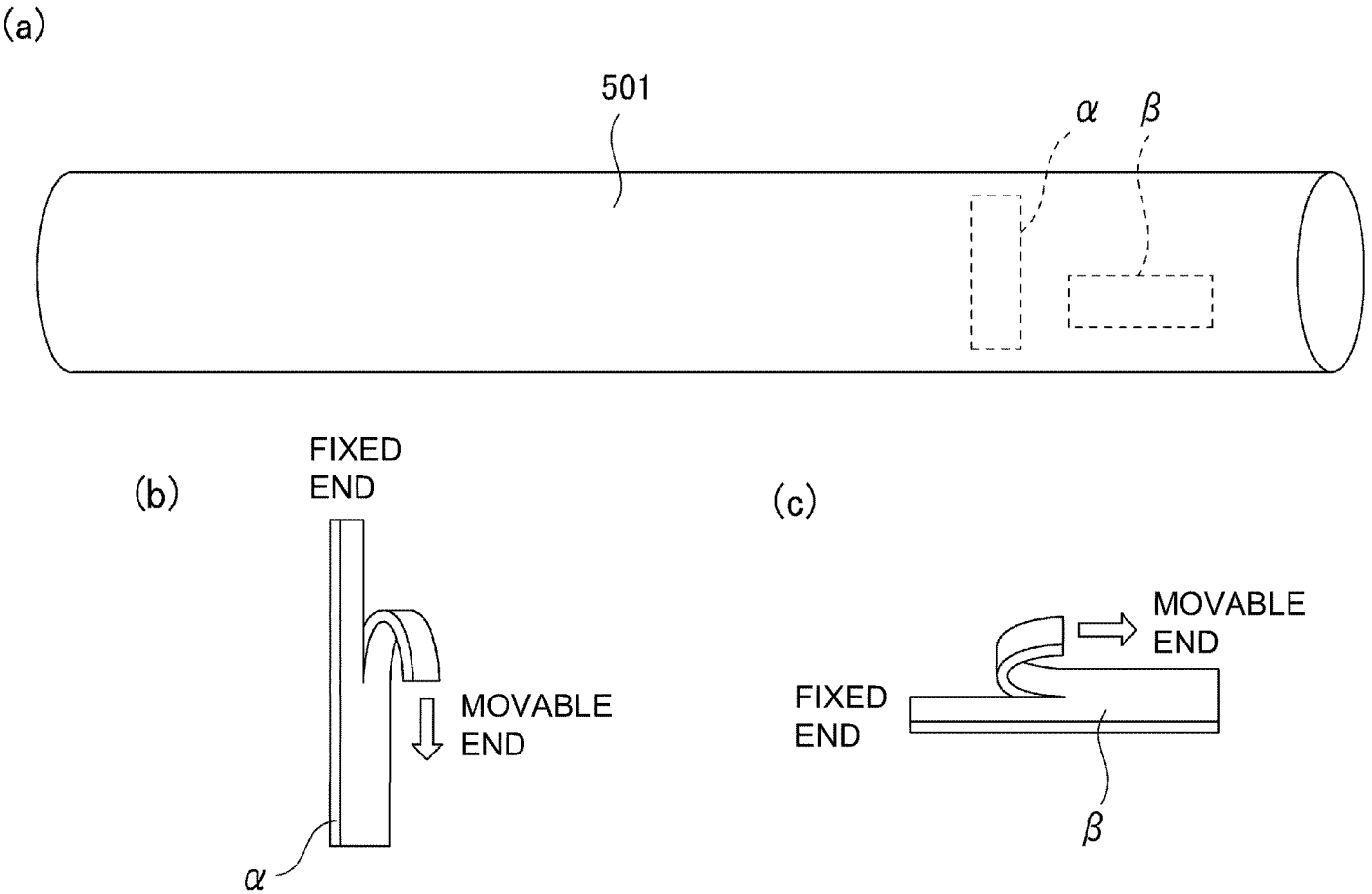
In FIG. 8, (a) is a schematic view of the fluorine-containing resin tube, (b) is a schematic view showing a part of the fluorine-containing resin tube where the fluorine-containing resin tube is split in a circumferential direction, and (c) is a schematic view showing a part of the fluorine-containing resin tube where the fluorine-containing resin tube is split in a longitudinal direction.

An experiment conducted for checking the degree of orientation will be described using FIGS. 8 and 9. First, as shown in (a) of FIG. 8, PFA is subjected to the extrusion molding, so that a 40 μm-thick fluorine-containing resin tube 501 is formed. A part of the fluorine-containing resin tube 501 is sampled by being out in a substantially rectangular shape with respect to each of the circumferential direction and the longitudinal direction. The sample extending in the circumferential direction is α, and the sample extending in the longitudinal direction is β. The sampled α is shown in (b) of FIG. 8, and the sample β is shown in (c) of FIG. 8. As shown in (b) of FIG. 8, a part of the sample α was cut along the circumferential direction, and one end portion of the cut portion was fixed and the other end portion of the cut portion was moved in the circumferential direction. Similarly, as shown in (c) of FIG. 8, a part of the sample β was cut along the longitudinal direction, and one end portion of the cut portion was fixed and the other end portion of the cut portion was moved in the longitudinal direction. A result of this is shown in FIG. 9.

Figure 9:
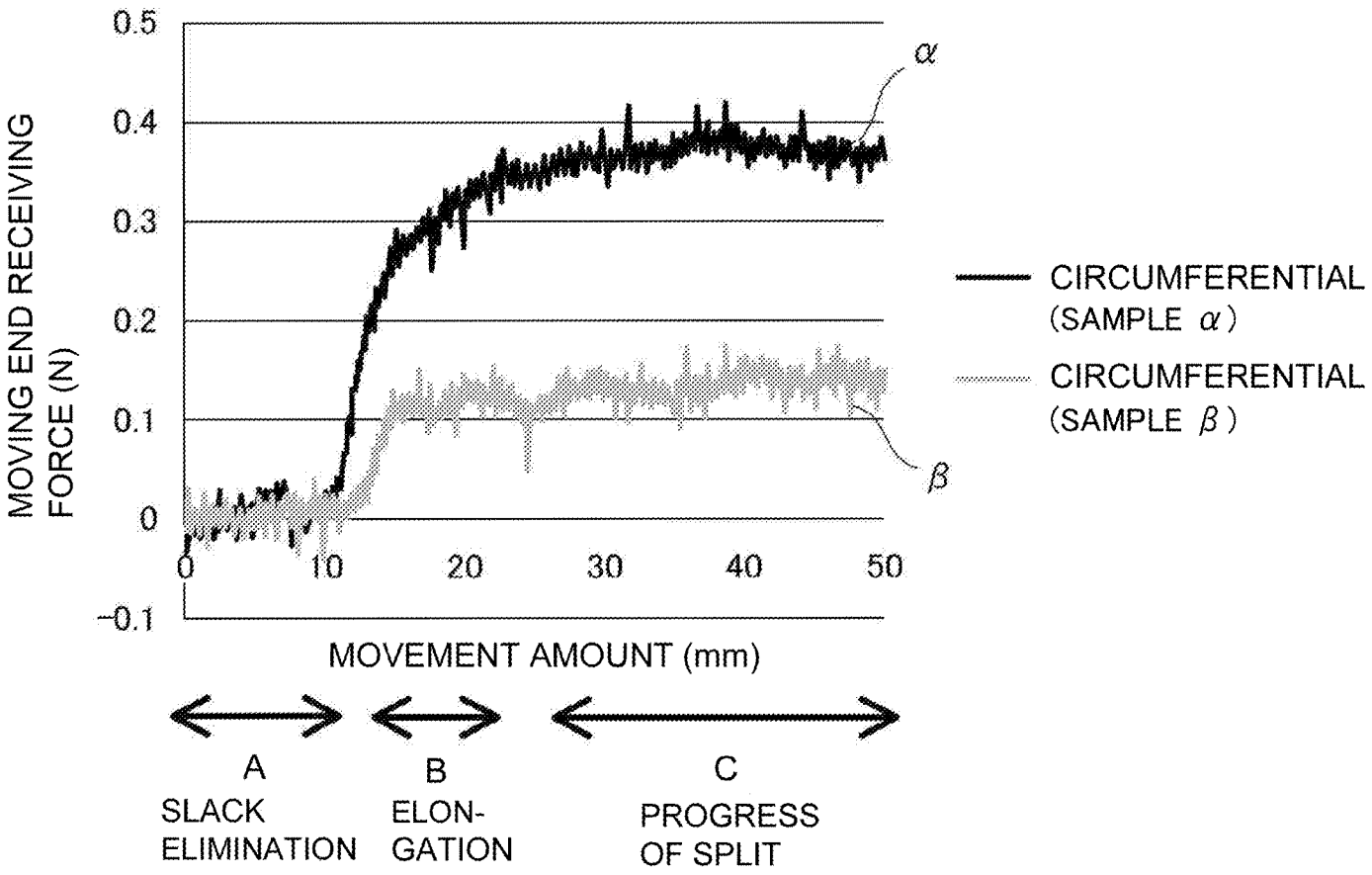
FIG. 9 is a graph showing a relationship between a movable belt receiving force and a movement amount when the fluorine-containing resin tube is split in each of the circumferential direction and the longitudinal direction.

FIG. 9 shows progression of a load (moving end receiving force) measured in a fixed end side in the case where each of the samples α and β is split, and in FIG. 9, the abscissa represents a movement amount of the moving end. In a region A of the abscissa, slack of each of the samples α and β is eliminated, and in a region B, elongation of each of the samples α and β generates in an unsplit state. In a region C, each of the samples α and β is in a state in which the sample continuously splits. When strength in a state in which the split progresses with a certain force is defined as split strength of the PFA, it is understood that the split strength of the oriented PFA in an orientation direction (longitudinal direction) is merely about ⅓ of the split strength of the oriented PFA in the circumferential direction. From the above, a force for splitting the fluorine-containing resin tube 501 has a property such that the force is weak in the case where the fluorine-containing resin tube 501 is cut along the orientation direction (longitudinal direction). That is, the fluorine-containing resin tube 501 constituting the surface layer 201B is liable to split in the longitudinal direction. For this reason, in the case where the recessed portion is formed on the surface layer 201B by the laser along a direction parallel to the longitudinal direction, the surface layer 201B is liable to split along the recessed portion. Thus, in the case where the split strength with respect to the orientation direction (longitudinal direction) of the PFA is lower than the split strength with respect to the circumferential direction, i.e., in the case where a ratio of the split strength with respect to the circumferential direction to the split strength with respect to the PFA orientation direction (longitudinal direction) is less than 1, as in this embodiment, it is desirable that the laser marking is effected. Particularly, in the case where the ratio of the split strength with respect to the circumferential direction to the split strength with respect to the PFA orientation direction (longitudinal direction) is 0.5 or less, the laser marking may desirably be made as in this embodiment.

[Recording Portion]

Therefore, in the case of this embodiment, the recessed portion 301 for displaying the information 300 is formed so that a font constituting the information 300 is inclined with respect to the longitudinal direction (direction which extends along the surface of the fixing belt 201 and which is a perpendicular direction perpendicular to a rotational direction of the fixing belt 201). That is, in the above-described second step, the recessed portion 301 is formed using a font processed so as to incline with respect to the longitudinal direction. Incidentally, the font constituting the information 300 may preferably be inclined relative to the longitudinal direction with an angle of 5° or more and 85° or less, more preferably be 10° or more and 80° or less.

Figure 10:
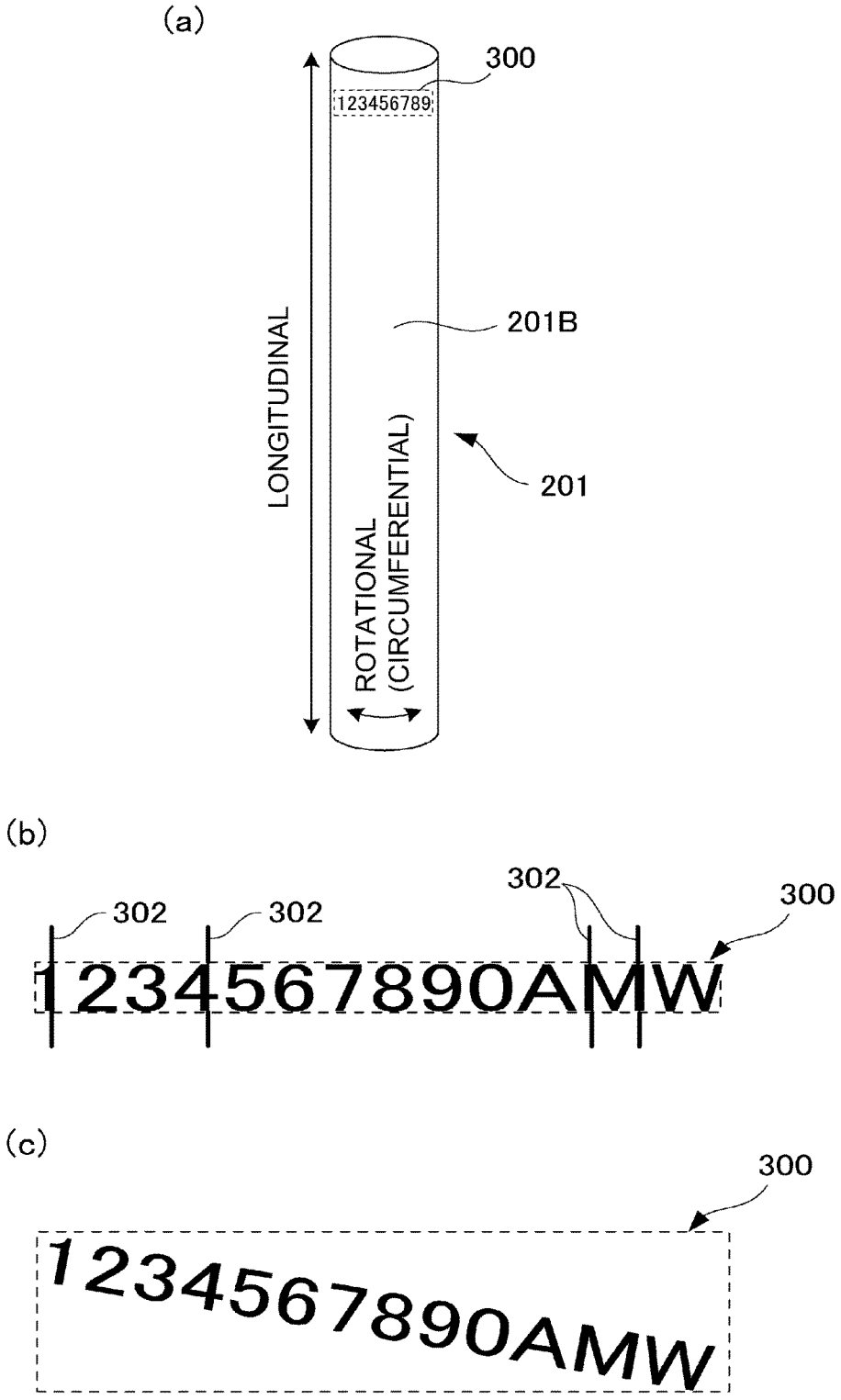
In FIG. 10, (a) is a schematic view showing a fixing belt which is an object in first Embodiment, (b) is a schematic view for illustrating marking in Comparison Example, and (c) is a schematic view for illustrating marking in a first Embodiment.

Specifically, as shown in (a) of FIG. 10, at an end portion of the fixing belt 201 in a non-image range of the surface of the surface layer 201B, the recessed portion 301 ((a) of FIG. 1) for displaying the information 300 is formed by the laser marking. Incidentally, in the following, for convenience of explanation, as the information 300, "1234567890AMW" is used, but the information 300 is not limited thereto. Further, in this embodiment, as the information 300, information of a plurality of characters or figures (only the characters in the illustrated example) arranged in a predetermined direction.

Here, when the font constituting the information 300 is not inclined with respect to the longitudinal direction, the font is as shown in (b) of FIG. 10, so that the recessed portion 301 can be formed along the longitudinal direction at portions of the characters "1", "4" and "M". That is, in (b) of FIG. 10, the predetermined direction which is an arrangement direction of the characters of the information 300 is a perpendicular direction perpendicular to the longitudinal direction, i.e., is the rotational direction of the fixing belt 201. Each of the characters "1", "4" and "M" includes a rectilinear line portion continuously extending in the direction perpendicular to the predetermined direction, i.e., a direction parallel to the longitudinal direction by 1 mm or more. Or, the character includes a rectilinear line portion continuously extending in the direction parallel to the longitudinal direction with a length which is ⅓ or more of a height of the font. For this reason, a split 302 is liable to generate along the recessed portion 301 at the rectilinear line portion parallel to the longitudinal direction.

On the other hand, in this embodiment, as shown in (c) of FIG. 10, the recessed portion 301 is formed so that the font of the information 300 is inclined with respect to the longitudinal direction. Specifically, the recessed portion 301 for displaying the information 300 is formed so that the predetermined direction which is the arrangement direction of the characters is inclined with respect to the longitudinal direction. An inclination angle of the predetermined direction relative to the rotational direction may preferably be 5° or more and 85° or less, more preferably be 10° or more and 80° or less. In the illustrated example, the arrangement direction (predetermined direction) of the characters subjected to the laser marking on the surface layer 201B was inclined clockwisely by 10° from the circumferential direction (rotational direction) of the fixing belt 201. Incidentally, a constitution in which the arrangement direction of the characters is parallel to the rotational direction and only each of the characters is inclined at an associated position may also be employed. Further, the reason why 90° is excluded from the angle of the predetermined direction relative to the rotational direction is that for example, a portion which is originally perpendicular to the longitudinal direction, such as a horizontal line portion of a character "T" is parallel to the longitudinal direction by being inclined by 90°.

As an inclination direction, in the case of a numeral "1" for example, even a clockwise direction and a counterclockwise direction are effective since these directions are deviated from the PFA orientation direction. However, with regard to a character including an originally inclined (rectilinear) line, such as "7", when the character is rotated (inclined) in a further inclined direction, the inclined portion of the character is not aligned with (parallel to) the PFA alignment direction and therefore is better against the split. In general, in lot marking, arabic numerals are used in many cases and are inclined rightwardly, and therefore, as the rotational direction in the lot marking, the clockwise direction is desirable. Further, in a condition such that the number of characters subjected to the lot marking is large, that the font is large and that the inclination angle is large, an area necessary for the lot marking increases and thus the characters cannot be completely written in the non-image range of the fixing belt 201 in some cases. For this reason, it is undesirable that the inclination angle of the font with respect to the longitudinal direction is made large more than necessary, so that in this embodiment, the inclination angle was 10°.

As a result, the font constituting the information 300 can be inclined with respect to the longitudinal direction, so that even the rectilinear line portion, extending in the direction parallel to the longitudinal direction, contained in the characters "1", "4" and "M" as shown in (b) of FIG. 10 is inclined with respect to the longitudinal direction. Further, also with regard to "7", the rectilinear line portion is inclined with respect to the longitudinal direction.

According to this embodiment as described above, even when the recessed portion 301 for displaying the information 300 is formed on the surface layer 201B, the split does not readily reach the image range. That is, it is possible to reduce a degree of a state in which the rectilinear line portion contained in the character or the figure is parallel to the longitudinal direction, and therefore it is also possible to reduce a degree of formation of the recessed portion 301 along the longitudinal direction in which the split is liable to generate. As a result, the split does not readily generate at the recessed portion 301 constituting the information 300, so that it is also possible to suppress arrival of the split at the image range. Further, generation of image defect due to the split is suppressed, so that a high-quality image can be formed for a long term.

Here, as in the constitution described above in JP-A 2005-338350, in the case where the surface layer is formed after marking (formation of the information by the recessed portion) of the lot number or the like onto the elastic layer surface is made, the surface layer is required to be a transparent member. However, as in this case, in the constitution in which electroconductivity is imparted by adding the carbon black or the like into the surface layer, the surface layer is non-transparent and therefore it is difficult to visually recognize the marking of the elastic layer through the surface layer. On the other hand, in this embodiment, the marking is effected on the surface layer 201B, and therefore even when the surface layer 201B is non-transparent, the marking can be visually recognized, and in addition, as described above, the split does not readily generate in the marking.

Further, as in this embodiment, in the case where an electroconductive material (member) such as the carbon black for imparting the electroconductivity to the surface layer 201B is added to the surface layer 201B, strength of the surface layer 201B lowers in some instances. However, the recessed portion 301 is formed as in this embodiment, so that even when the strength of the surface layer 201B lowers, it is possible to realize less generation of the split.

Second Embodiment

Figure 11:
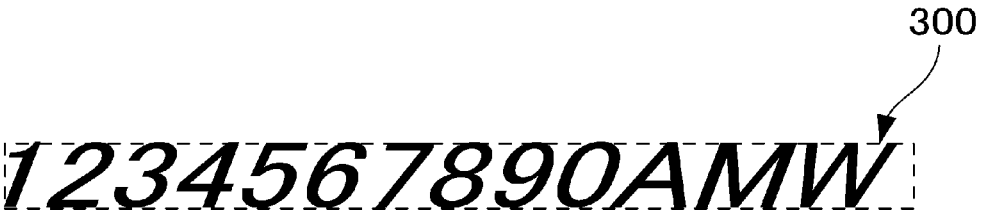
FIG. 11 is a schematic view for illustrating marking in second Embodiment.

Second Embodiment will be described using FIGS. 11 and 12. In this embodiment, the force of the information 300 formed in the non-image range of the surface layer 201B is a slanted character (slanted face). That is, in the second step described in first Embodiment, the recessed portion is formed using a slanted font. Specifically, as shown in FIG. 11, the font of the character subjected to the laser marking on the surface layer 201B was set at the slanted character (slanted font), and the information 300 was marked (printed) so that the recessed portion direction which was the character arrangement direction was parallel to the circumferential direction of the fixing belt 201. For example, the information 300 is characters visually recognizable by the recessed portion 301 formed on the surface layer 201B and is a character portion where characters selected from alphabetical and numeral characters are arranged along the circumferential direction of the fixing belt 201. Further, the character portion is constituted by the slanted character inclined with respect to the longitudinal direction of the fixing belt 201. Here, the slanted character includes a character such as an italic face which is designed in an inclined manner and an oblique face which is obtained by inclining an uninclined character by image processing. Incidentally, specific examples of the fonts, normal faces thereof and italic faces thereof are shown in FIG. 12.

According to this embodiment, for example, even in the rectilinear line portion, extending in the direction parallel to the longitudinal direction, contained in the characters "1", "4" and "M" as shown in (b) of FIG. 10 described above is inclined with respect to the longitudinal direction. For this reason, similarly as in first Embodiment, it is possible to reduce a degree of formation of the recessed portion 301 along the longitudinal direction in which the split is liable to generate. Other constitutions and actions are similar to those in First Embodiment.

Third Embodiment

Third Embodiment will be described using FIGS. 13 and 14. In the case of this embodiment, as shown in 8*a*) of FIG. 13, within the non-image range of the surface of the surface layer 201B, an image-side recessed portion 303 extending along the rotational direction of the fixing belt 201 is formed. That is, in this embodiment, the font of the information 300 is not inclined as in First Embodiment and also is not the slanted font as in Second Embodiment. For this reason, as shown in (b) of FIG. 10 described above, the recessed portion of the rectilinear line portion parallel to the longitudinal direction generates, so that the split can generate along this recessed portion of the rectilinear line portion. Therefore, in this embodiment, between the information 300 and the image range, the image-side recessed portion 303 is formed along the circumferential direction by the laser marking.

In summary, the recessed portion 301 for displaying the information 300 includes the rectilinear line portion having an angle in a range from −10° to +10° (−10° or more and +10° or less) with respect to the longitudinal direction. For this reason, in this embodiment, within the non-image range of the surface of the surface layer 201B, the image-side recessed portion 303 different from the recessed portion 301 constituting the information 300 is formed so as to cross a phantom line extended from an end portion of the rectilinear line portion in the image range side toward the image range in the longitudinal direction. When such a condition is satisfied, the image-side recessed portion 303 may also be parallel to the rotational direction of the fixing belt 201 or may also be inclined with respect to the rotational direction of the fixing belt 201. The image-side recessed portion 303 may also be formed in a rectilinear shape, a curved shape or a wavy shape. However, it is preferable that the image-side recessed portion 303 does not contain the rectilinear line portion having the angle in the range from −10° to +10° with respect to the longitudinal direction. That is, it is preferable that the image-side recessed portion 303 is formed so as not to contain the rectilinear line portion having the angle in the range from −10° to +10° with respect to the longitudinal direction. Basis of the direction of the angle with respect to the longitudinal direction may be either of the clockwise direction and the counterclockwise direction, but herein, the clockwise direction is a "+" direction.

Thus, by forming the image-side recessed portion 303 between the information 300 and the image range, even when the recessed portion consisting of the rectilinear line portion having the angle in the range from −10° to +10° with respect to the longitudinal direction is contained in the information 300, it is possible to suppress the arrival of the split at the image range. That is, even when the split generates along this recessed portion, the split stops at the image-side recessed portion 303, and therefore it is possible to suppress the arrival of the split at the image range. As a result, generation of the image defect due to the split is suppressed, so that the high-quality image can be formed over a long term.

Figure 13:
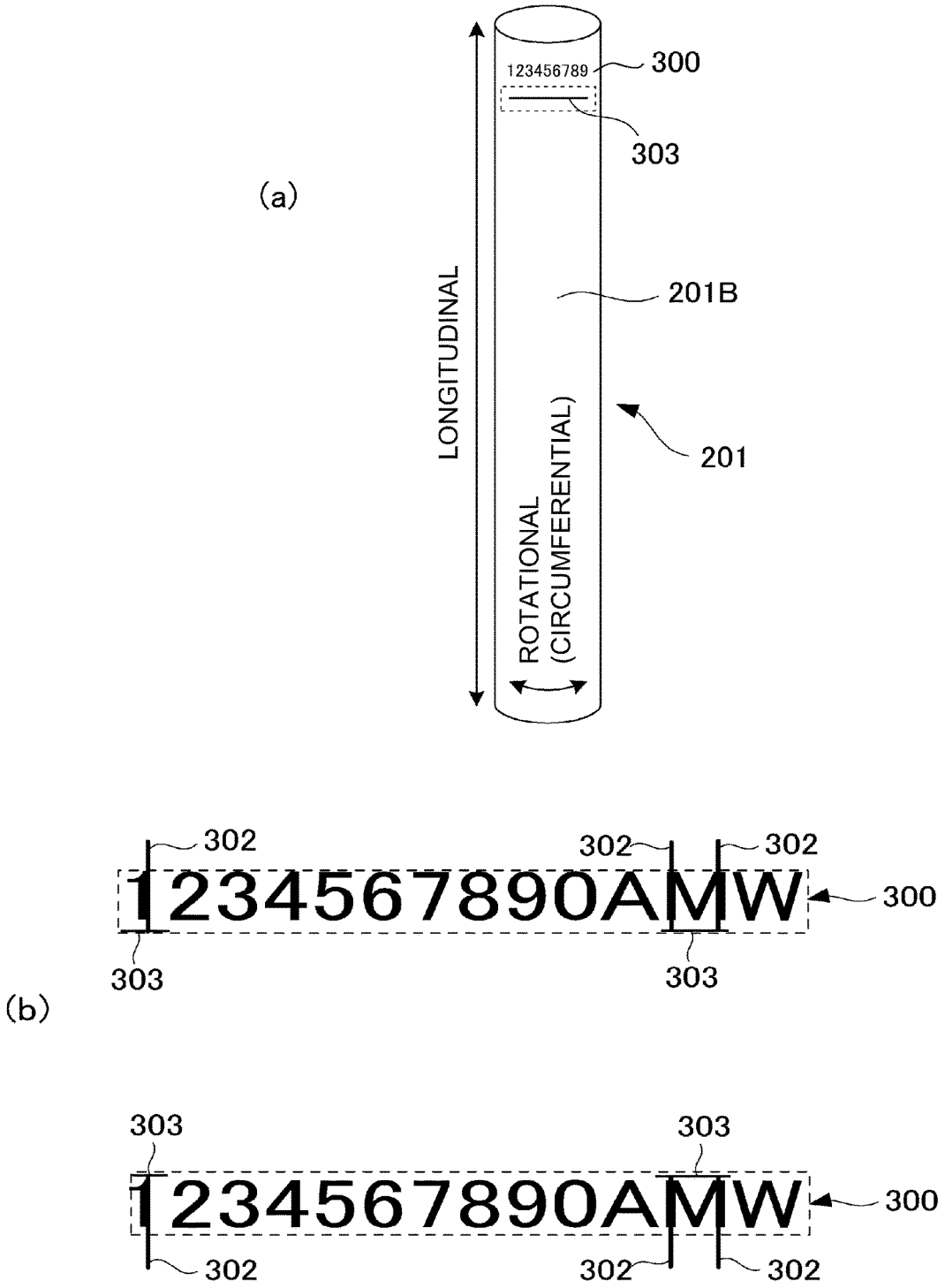
In FIG. 13, (a) is a schematic view of a fixing belt which is an object in third Embodiment, and (b) is a schematic view for illustrating marking in third Embodiment.

Such an image-side recessed portion 303 may also be formed between an entirety of the information 300 with respect to the circumferential direction and the image range, but may also be formed between a part of the information 300 and the image range as shown in (b) of FIG. 13. An upper side of (b) of FIG. 13 shows the case where the information 300 is formed in one end side (upper side) of the fixing belt 201 with respect to the longitudinal direction of the fixing belt 201 shown in (a) of FIG. 13. A lower side of (b) of FIG. 13 shows the case where the information 300 is formed in the other end side (lower side) of the fixing belt 201 with respect to the longitudinal direction of the fixing belt 201 shown in (a) of FIG. 13. In either case, the information 300 is formed as shown in (b) of FIG. 10. For this reason, the recessed portion consisting of the rectilinear line portion extending in the direction parallel to the longitudinal direction generates in the characters "1", "4" and "M". Accordingly, in (b) of FIG. 13, the image-side recessed portion 303 is formed only between each of the characters "1", "4" and "M" and the image range (the image-side recessed portion 303 for "4" is omitted from illustration). That is, in the case of the upper side of (b) of FIG. 13, the image-side recessed portion 303 is formed in a lower side of an associated character, and in the case of the lower side of (b) of FIG. 13, the image-side recessed portion 303 is formed in an upper side of the associated character. Also by this, similarly, even when the split generates along the recessed portion consisting of the rectilinear line portion, the split stops at the image-side recessed portion 303. That is, the image-side recessed portion 303 may only be required to be formed at least in an image range side of this rectilinear line portion with respect to the longitudinal direction.

Further, the above-described image-side recessed portion 303 shown in (a) and (b) of FIG. 13 may only be required to be a rectilinear line portion inclined with an inclination angle of 10° or more and 80° or less with respect to the rotational direction of the fixing belt 201 or a combination of a plurality of such rectilinear line portions. Specifically, as shown in (a) of FIG. 14, the image-side recessed portion 303 may also be formed by connecting a plurality of recessed portions 303*a* consisting of rectilinear line portions different in inclination angle from each other while being inclined with inclination angles of 10° or more and 80° or less with respect to the rotational direction. Further, as shown in (b) of FIG. 14, the image-side recessed portion 303 may also be formed in a substantially curved shape by connecting a large number of recessed portions 303*a* consisting of rectilinear line portions.

Figure 14:
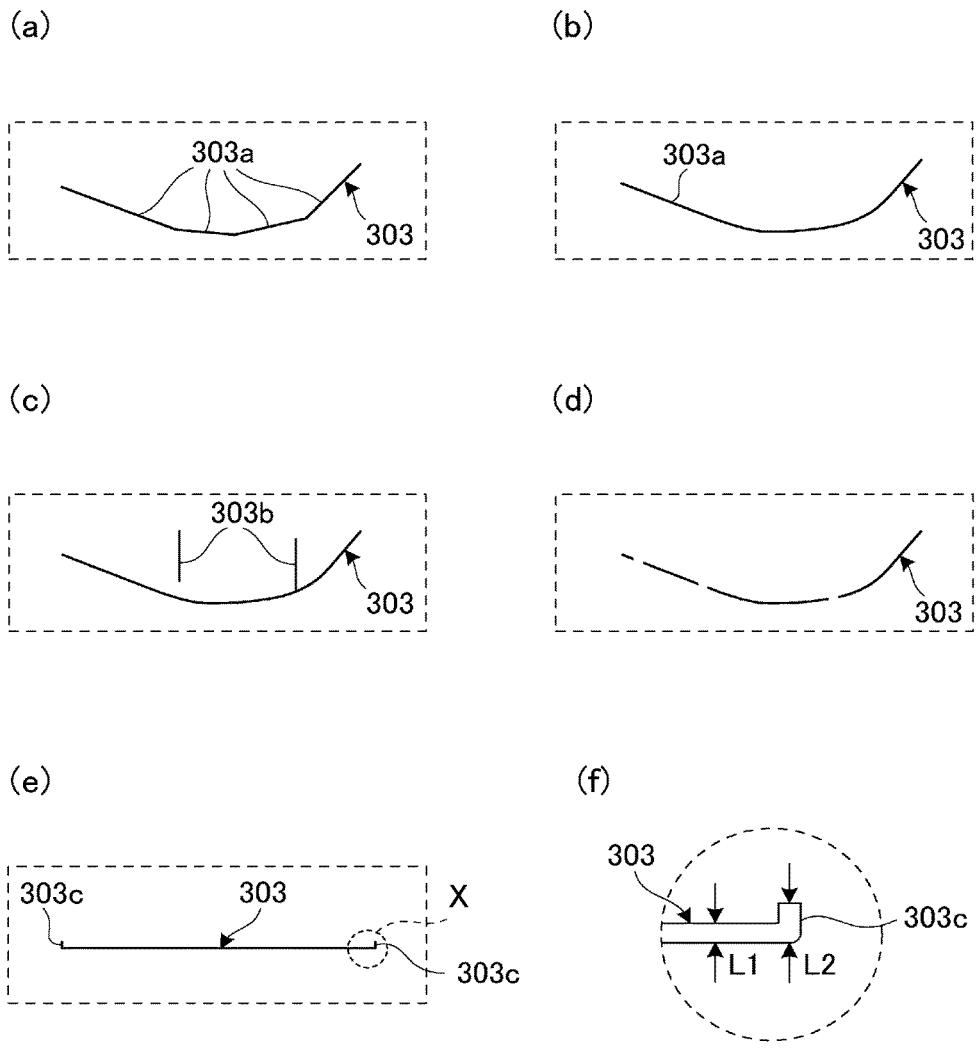
In FIG. 14, (a) to (f) are schematic views each showing an image side recessed portion in third Embodiment, in which (a) shows a first example, (b) shows a second example, (c) shows a third example, (d) shows a fourth example, (e) shows a fifth example, and (f) is an enlarged view of portion X in (e) of FIG. 14.

Further, as shown in (e) of FIG. 14, the image-side recessed portion 303 may also be provided with another recessed portion 303*b* in a side opposite from the image range with respect to the image-side recessed portion 303. Further, as shown in (d) of FIG. 14, the image-side recessed portion 303 may also be partly broken. However, in this case, on an extension line of the recessed portion consisting of the rectilinear line portion, extending in the direction parallel to the longitudinal direction, contained in the characters "1", "4" and "M" as shown in (b) of FIG. 10, the image-side recessed portion 303 exists.

Further, as shown in (e) of FIG. 14, the image-side recessed portion 303 may also include a minute recessed portion 303*c* where the angle with respect to the longitudinal direction is in the range from −10° to +10° but the split does not readily generate along the longitudinal direction. For example, when the recessed portion formed on the surface of the surface layer 201B by the laser does not readily split along the longitudinal direction has a square shape having the same width with respect to the longitudinal direction and the rotational direction or a shape close to a circle. Here, as shown in (f) of FIG. 14, a width of the image-side recessed portion 303 with respect to the longitudinal direction of the fixing belt 201 is L1, and a length of the minute recessed portion 303*c* with respect to the longitudinal direction is L2. In this case, when the minute recessed portion 303*c* is a small recessed portion such that the length L2 is less than 2 times the width L1 of the image-side recessed portion 303 (i.e., $L2<2\times L1$), the minute recessed portion 303*c* may also be included in the image-side recessed portion 303. Incidentally, such a minute recessed portion 303*c* has the short length L2, and therefore is not included in "the rectilinear line portion having an angle in a range from −10° to +10° with respect to the longitudinal direction (perpendicular direction)". Other constitutions and actions are similar to those in first Embodiment.

Fourth Embodiment

Figure 15:
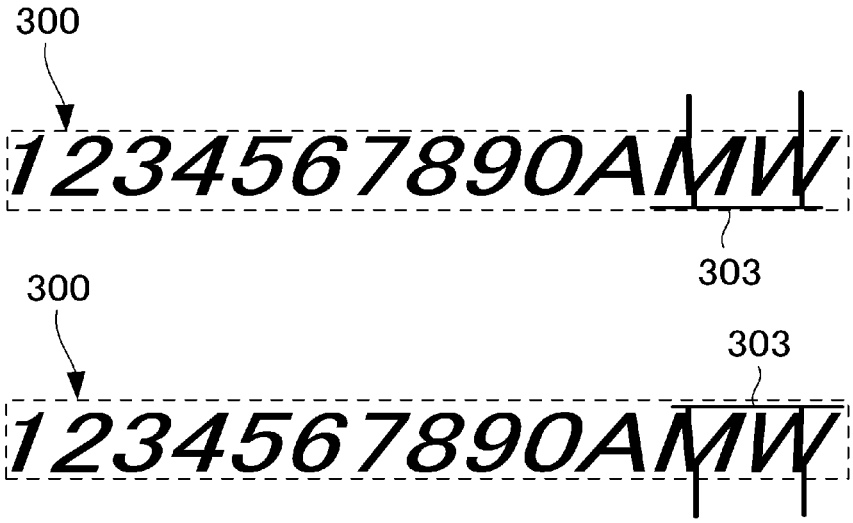
FIG. 15 is a schematic view for illustrating marking in fourth Embodiment.

Fourth Embodiment will be described using FIG. 15. In this embodiment, not only the font of the information 300 is the slanted font (slanted character) as in the above-described Second Embodiment but also the image-side recessed portion 303 is formed between the information 300 and the image range as in the above-described Third Embodiment. That is, as shown in FIG. 15, even when the font is the slanted font, depending on the species of the font, the recessed portion consisting of the rectilinear line portion extending in the direction parallel to the longitudinal direction of the fixing belt 201 can generate. For example, the recessed portion consisting of the rectilinear line portion can generate in the characters "M" and "W". Further, the split 302 is liable generate along the recessed portion consisting of the rectilinear line portion. For this reason, in this embodiment, similarly as in Third Embodiment, the image-side recessed portion 303 is formed between the information 300 and the image range.

Incidentally, as shown in FIG. 15, the image-side recessed portion 303 may also be formed between the image range and the character containing the recessed portion consisting of the rectilinear line portion extending in the direction parallel to the longitudinal direction. As a result, a formation range of the image-side recessed portion 303 can be made small. In this embodiment, the font of the information 300 is the slanted font, and therefore it is possible to reduce a degree of the formation of the recessed portion consisting of the rectilinear line portion parallel to the longitudinal direction and it is also possible to suppress the arrival of the split at the image range by the image-side recessed portion 303 even when such a rectilinear line portion generate. Other constitutions and actions are similar to those in Second and Third Embodiments.

Fifth Embodiment

Fifth Embodiment will be described using FIG. 16. In the above-described Third and Fourth Embodiments, the image-side recessed portion 303 was formed in the image range side of the information 300. However, also a constitution in which the fixing belt is extended and stretched around a plurality of stretching rollers has been conventionally known. In the case of such a constitution, by the influence of alignment or the like of the stretching rollers, "shift" such that the fixing belt moves in a widthwise direction (longitudinal direction, perpendicular direction) perpendicular to the rotational direction generates. For this reason, conventionally, a constitution in which a position of a widthwise end portion of the fixing belt is detected by a sensor and the shift of the fixing belt is controlled has been known.

Figure 16:
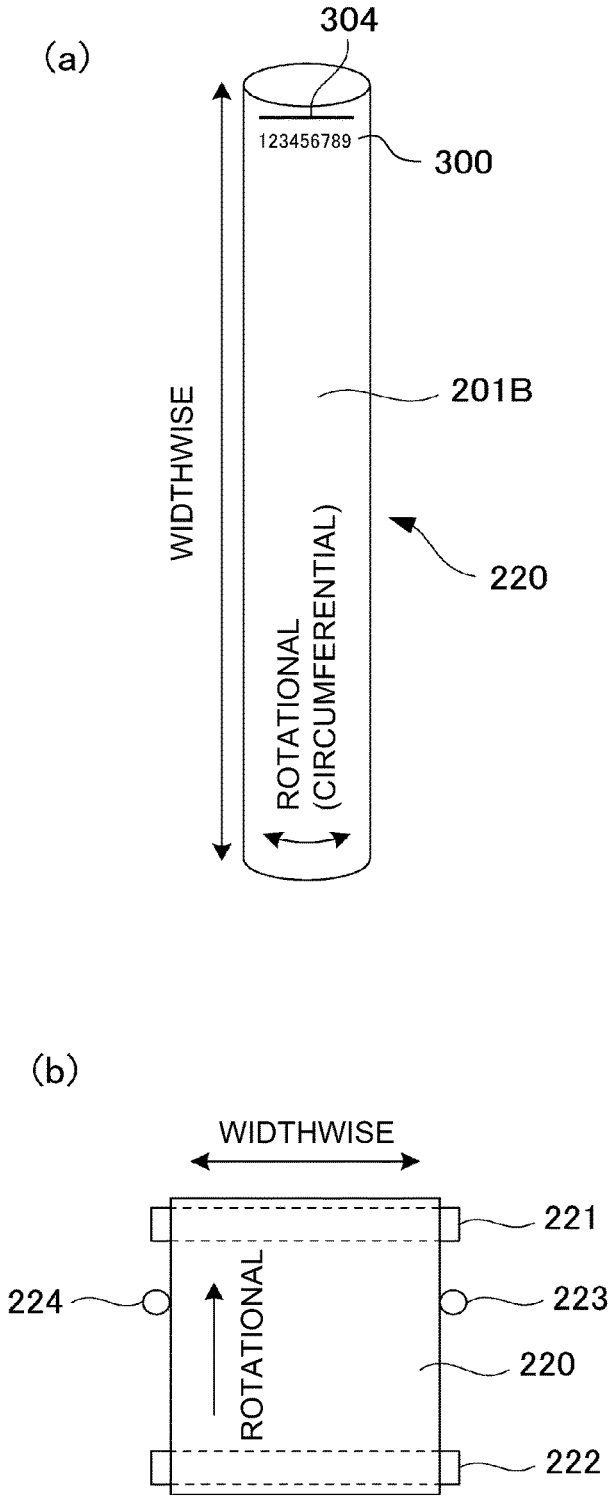
In FIG. 16, (a) is a schematic view showing a fixing belt which is an object in fifth Embodiment, and (b) is a schematic view for illustrating fixing belt shift control in fifth Embodiment.

Specifically, in the case of this embodiment, a fixing belt 220 which is a rotatable member and a heating member is formed as shown in (a) of FIG. 16 and has a surface layer 201B at its surface similarly as in the above-described embodiments. Further, in the case where such a fixing belt 220 is incorporated in the fixing direction, as shown in (b) of FIG. 16, the fixing belt 220 is stretched by stretching rollers 221 and 222. Here, either one of the stretching rollers 221 and 222 is a steering roller for controlling the shift of the fixing belt 220 by being inclined. Further, at positions opposing widthwise end portions of the fixing belt 220, contact (type) sensors 223 and 224 are provided.

In the case where the shift of the fixing belt 220 is controlled, the steering roller is tilted (inclined) so that when one of the sensors 223 and 224 with respect to the widthwise direction contacts the associated widthwise end portion of the fixing belt 220, the fixing belt 220 is moved in a direction toward the other sensor with respect to the widthwise direction. By repeating this operation, the fixing belt 220 is subjected to shift control.

Here, in the case of the constitution in which the sensors 223 and 224 are contactable to the associated widthwise end portions of the fixing belt 220, a load is exerted on the associated widthwise end portion. For this reason, in the case where the information 300 as described above is formed at the widthwise end portion of the fixing belt 220 and the recessed portion consisting of the rectilinear line portion parallel to the widthwise direction is contained in the information 300, there is a possibility that the split generates in the recessed portion consisting of the rectilinear line portion and reaches the widthwise end portion. When the split generates at the widthwise end portion of the fixing belt 220, detection by the sensors 223 and 224 cannot be made with accuracy.

Therefore, in this embodiment, as shown in (a) of FIG. 16, an end portion-side recessed portion 304 extending along the rotational direction of the fixing belt 220 is formed by the laser marking in a side closer to the widthwise end portion of the fixing belt 220 than the information 300 within the non-image ranges. The recessed portion constituting the information 300 in this embodiment may be formed by inclining the font as in First Embodiment and may also be formed by using the slanted font (slanted character) as the font as in Second Embodiment. Further, the end portion-side recessed portion 304 is a rectilinear line portion inclined with an angle of 10° or more and 80° or less with respect to the rotational direction of the fixing belt 220 or a recessed portion different from the recessed portion constituting the information 300 consisting of a combination of a plurality of rectilinear line portions. Further, it is preferable that the end portion-side recessed portion 304 does not contain a rectilinear line portion having the angle in the range from −10° to +10° with respect to the widthwise direction. Further, the end portion-side recessed portion 304 may also be formed so as to extend through one-full-circumference with respect to the rotational direction of the fixing belt 220. At this time, the angle of the end portion-side recessed portion 304 with respect to the rotational direction in such an angle that the end portion-side recessed portion 304 does not reach the image range (first region) even when the end portion-side recessed portion 304 extends through the one-full-circumference. Such an end portion-side recessed portion 304 can be formed in, e.g., shapes as shown in (a) to (e) of FIG. 14 similarly as in the case of the image-side recessed portion 303 described above in Third and Fourth Embodiments.

Further, this embodiment may also be combined with Third and Fourth Embodiments. That is, the image-side recessed portion 303 and the end portion-side recessed portion 304 may also be formed in the image range side of the information 300 and the end portion side of the belt, respectively. Further, the information 300 contains the recessed portion consisting of the rectilinear line portion parallel to the widthwise direction as in Third and Fourth Embodiments, the end portion-side recessed portion 304 may only be required to be formed at least in the belt end portion side of this rectilinear line portion with respect to the longitudinal direction.

For example, as shown in (b) of FIG. 13 described above, the recessed portion consisting of the rectilinear line portion extending in the direction the longitudinal direction in the characters "1", "4" and "M" exists, only between the belt end portion and each of the characters "1", "4" and "M", the end portion-side recessed portion 304 may also be formed.

In the case of this embodiment described above, the end portion-side recessed portion 304 is formed in the belt end portion side of the information 300, and therefore even when the split generates in the recessed portion constituting the information 300, this split stops at the end portion-side recessed portion 304, so that it is possible to suppress the arrival of the split at the end portion of the fixing belt 220.

Embodiments

An experiment conducted for checking effects of First to Third Embodiments by using Embodiments 1 to 3 corresponding to First to Third Embodiments, respectively and Comparison Example will be described. Incidentally, the information 300 was formed on the surface of the surface layer as shown in (c) of FIG. 10 in First Embodiment for Embodiment 1, FIG. 11 in Second Embodiment for Embodiment 2, (b) of FIG. 13 in Third Embodiment for Embodiment 3 and (b) of FIG. 10 for Comparison Example.

First, the fixing belt 201 used in this experiment will be described. In order to prepare the fixing belt 201, as a polyimide precursor solution, an N-methyl-2-pyrrolidone solution of a polyimide precursor consisting of 3,3',4,4'-biphenyltetracarboxylic dianhydride and paraphenylenediamine was prepared. This precursor solution was applied onto an inner surface of the above-described substrate 201*a* formed of the nickel-iron alloy in an inner diameter of 30 mm, a thickness of 40 μm and a length of 400 mm and was imidized by being backed at 200° C. for 20 min., so that a 20 μm-thick sliding layer 201*b* was formed.

On an outer surface of the substrate 201*a*, a hydroxyl (type) silicone primer ("DY39-051 A/B", manufactured by Shin-Etsu Chemical Co., Ltd.) was coated and was baked at 200° C. for 5 min. Then, as an outer layer thereof, a 300 μm-thick addition-curable silicone rubber was coated and was baked at 200° C. for 30 min., so that an elastic layer 201*d* was formed. At this time, as the coated addition-curable silicone rubber, a silicone rubber mixture was used. The silicone rubber mixture can be obtained in the following manner. First, high-purity spherical alumina particles as an inorganic filler is mixed in a commercially available addition-curable silicone rubber undiluted solution in a volume ratio of 25% on the basis of a cured silicone rubber layer. Thereafter, vapor deposition (vapor-phase growth) carbon fibers are added and kneaded in a volume ratio of 2.0%, so that the silicone rubber mixture was obtained. As the commercially available addition-curable silicone rubber undiluted solution, an equivalent mixture of "A liquid" and "B liquid" (trade name: "SE 1886", manufactured by Dow Corning Toray Co., Ltd.) was used. As the high-purity spherical alumina particles, alumina beads (trade name: "ALUMINABEADS CB-A25BC", manufactured by Showa Denko Ceramics Co., Ltd.) was used. As the vapor deposition carbon fibers, carbon fibers (trade name: "VGCF-S", manufactured by Showa Denko K.K.) was used.

Further, on an outer surface of the elastic layer 201*d*, an addition-curable silicone rubber adhesive (trade name: "SE1819CV" which is an equivalent mixture of "A liquid" and "B liquid", manufactured by Dow Corning Toray Co., Ltd.) was uniformly coated so that a thickness was about 10 μm (adhesive layer 201*e*). Then, as the surface layer 201B formed of a fluorine-containing resin material, a fluorine-containing resin tube of 400 mm in length, 29 mm in inner diameter and 40 μm in thickness was laminated. The fluorine-containing resin tube used in this embodiment is molded by an extrusion molding (method) by using a fluorine-containing resin pellet (trade name: "Neoflon PFA AP230-AS", Daikin Industries, Ltd.) as a source material.

Thereafter, the belt surface was squeezed uniformly from an outside of the fluorine-containing resin tube, so that the excessive adhesive was squeezed out of between the elastic layer 201*e* and the fluorine-containing resin tube so as to become sufficiently thin. Then, the adhesive was cured by being heated for 1 hour in an electric furnace set at 200° C., so that the fluorine-containing resin tube was adhesively fixed on the elastic layer 201*d* and thus the surface layer 201B was formed.

The thus-obtained member (endless belt) was cut at both end portions thereof to uniformize a length thereof, so that the fixing belt 201 was prepared. Thereafter, in order to effect lot marking for the information 300 in the non-image range of the surface layer 201B, the laser irradiation was made using a laser marker ("ML-G9300", manufactured by KEYENCE Corp.), so that a predetermined was formed in a depth of 20 μm. The marked character was "0123456789AMW" and a height of the character was 3 mm. The character was marked as described in each of Embodiments 1 to 3 and Comparison Example.

Figure 2:
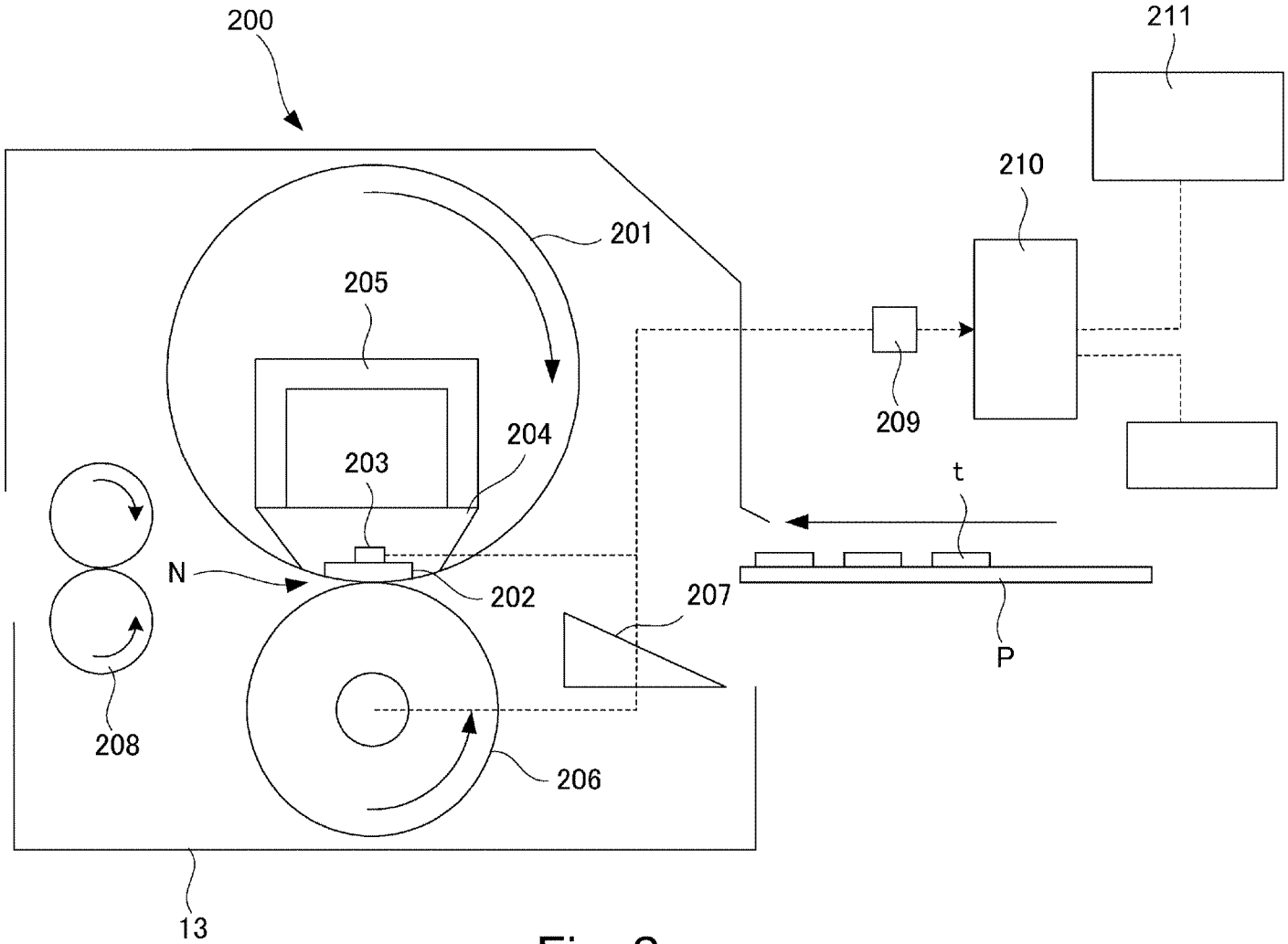
FIG. 2 is a schematic view of a fixing device in first Embodiment.

Then, each of the thus-formed fixing belts 201 of Embodiments 1 to 3 and Comparison Example was incorporated in the fixing device as shown in FIG. 2, and was operated under the following condition. First, a temperature of the fixing belt 201 was 170° C. The fixing belt 201 was continuously rotated at a certain rotational speed of 250 mm/sec while being pressed against the pressing roller 206 at pressure of 30 kgf. With the rotation, the marked portion where the information 300 was formed repetitively expanded and contracted, and therefore when the fixing belt 201 was rotated for a certain time or more, the split progressed from an end portion of the fixing belt 201 in the longitudinal direction of the fixing belt 201.

In this case, the time when the mark splits in 5 mm or more and the split progresses and reaches the image range of the fixing belt 201 is defined as a split lifetime. As a lifetime of the fixing belt 201, sheet passing of 300,000 sheets no A4-sized paper basis. That is, the fixing belt 201 was rotated for a time corresponding to the sheet passing of 300,000 sheets of the A4-sized paper of 210 mm in length with respect to a recording material feeding direction. Incidentally, for example, in the case where only A3-sized sheets of 420 mm in length with respect to the recording material feeding direction are passed through the fixing device, the sheet passing of 150,000 sheets which is half of the 300,000 sheets of the A4-sized paper corresponds to the sheet passing of 300,000 sheets of only the A4-sized paper.

Then, in Comparison Example and Embodiments 1 to 3, the presence or absence of the split when the fixing belt 201 was rotated for a rotation time corresponding to the 300,000 sheets of the A4-sized paper was evaluated. A result is shown in Table 1 below. In Table 1, in the case where 5-sheet printing was repeated, when the image defect due to the split did not generate at the time of the sheet passing of 300,000 sheets or more in total, evaluation of "o" was made, and when the image defect generated at the time of the sheet passing of less than 300,000 sheets in total, evaluation of "x" was made.

TABLE 1

| | AN*1 | POC*2 | NOTE |
|---|---|---|---|
| Comparison Example | x | x | — |
| EMB. 1 | ○ | ○ | Increase*3 |
| EMB. 2 | ○ | x | — |
| EMB. 3 | ○ | ○ | — |

*1"AN" is the arabic numeral.
*2"POC" is a part of the characters.
*3"Increase" is an increase in height of the marking with rotation.

As apparent from Table 1, as regards the arabic numeral, it was understood that in any Embodiments 1 to 3, compared with Comparison Example, the split lifetime was improved. On the other hand, in the case where there was a part of the characters, i.e., an slanted (inclined) character originally inclined with respect to the longitudinal direction of the fixing belt 201, such as the alphabet "M" or "W", there was a possibility that the character split even when the font was inclined as in Embodiment 1 or even when the slanted character was used as in Embodiment 2. In this case, it is also possible to make the lot marking without using split table characters, and therefore Embodiments 1 and 2 in which all of the arabic numerals are usable are also sufficiently effective. Further, in the case of Embodiment 3, the image defect due to the split did not generate.

Incidentally, in the case where there is a need to use the splittable characters in Embodiments 1 and 2, as in Fourth Embodiment, the image-side recessed portion 303 may only be required to be formed between the information 300 and the image range.

OTHER EMBODIMENT

The above-described embodiments can be carried out in combination appropriately. For example, not only the font of the information 300 may be the slanted character as in Second Embodiment but also the font may also be inclined as in First Embodiment. Further, the constitution in First Embodiment may also be combined with the constitution in Third Embodiment.

In the above-described embodiments, as the rotatable fixing member (rotatable feeding member), the fixing belt was used, but in the case where the information is formed on the pressing roller by the laser, the constitutions of the above-described embodiments can be similarly applied. That is, the constitutions of the above-described embodiments are applicable to at least one of the fixing belt and the pressing roller. Further, the rotatable fixing member (rotatable feeding member) can be appropriately used when the rotatable fixing member is a rotatable member, to which the information such as the production lot number is imparted, such as a conventionally known fixing roller or pressing belt. Further, an information forming method is not limited to the laser marking, but may also be marking using a cutter or the like.

Further, in FIG. 12 described above, a part of fonts in which the arabic numerals did not readily split by using the inclines as in Second Embodiment was shown. However, other than the fonts listed in FIG. 12, it is also possible to use fonts listed below, other fonts, original fonts with no formal font names, and modified fonts obtained by subjecting known fonts to ornament, a change in thickness of a line, a change in form of the line to a dotted line or the like.

(Font List)

Batang, BatangChe, DFKai-SB, Dotum, DotumChe, FangSong, Gulim, GulimChe, Gungsuh, GungsuhChe, KaiTi, Malgun Gothic, Microsoft JhengHei, Microsoft YaHei, MingLiU, MingLiU_HKSCS, MingLiU_HKSCS-ExtB, MingLiU-ExtB, NSimSun, PMingLiU, PMingLiU-ExtB, SimHei, SimSun, SimSun-ExtB, Agency FB, Aharoni, Algerian, Andalus, Angsana New, AngsanaUPC, Aparajita, AR BERKLEY, AR BLANCA, AR BONNIE, AR CARTER, AR CENA, AR CHRISTY, AR DARLING, AR DECODE, AR DELANEY, AR DESTINE, AR ESSENCE, AR HERMANN, AR JULIAN, Arabic Typesetting, Arial, Arial Black, Arial Narrow, Arial Rounded MT Bold, Baskerville Old Face, Bauhaus 93, Bell MT, Berlin Sans FB, Berlin Sans FB Demi, Bernard MT Condensed, Blackadder ITC, Bodoni MT, Bodoni MT Black, Bodoni MT Condensed, Bodoni MT Poster Compressed, Book Antigua, Bookman Old Style, Bookshelf Symbol 7, Bradley Hand ITC, Britannic Bold, Broadway, Browallia New, BrowalliaUPC, Brush Script MT, Calibri, Calibri Light, Californian FB, Calisto MT, Cambria, Cambria Math, Candara, Castellar, Centaur, Century, Century Gothic, Century Schoolbook, Chiller, Colonna MT, Comic Sans MS, Consolas, Constantia, Cooper Black, Copperplate Gothic Bold, Copperplate Gothic Light, Corbel, Cordia New, CordiaUPC, Courier New, Curlz MT, DaunPenh, David, DilleniaUPC, DokChampa, Ebrima, Edwardian Script ITC, Elephant, Engravers MT, Eras Bold ITC, Eras DemiITC, Eras Light ITC, Eras Medium ITC, Estrangelo Edessa, EucrosiaUPC, Euphemia, Felix Titling, Fluke89, Footlight MT Light, Forte, Franklin Gothic Book, Franklin Gothic Demi, Franklin Gothic Demi Cond, Franklin Gothic Heavy, Franklin Gothic Medium, Franklin Gothic Medium Cond, FrankRuehl, FreesiaUPC, Freestyle Script, French Script MT, Gabriola, Garamond, Gautami, Georgia, Gigi, Gill Sans MT, Gill Sans MT Condensed, Gill Sans MT Ext Condensed Bold, Gill Sans Ultra Bold, Gill Sans Ultra Bold Condensed, Gisha, Gloucester MT Extra Condensed, Goudy Old Style, Goudy Stout, Haettenschweiler, Harlow Solid Italic, Harrington, High Tower Text, Impact, Imprint MT Shadow, Informal Roman, IrisUPC, Iskoola Pota, JasmineUPC, Jokerman, Juice ITC, Kalinga, Kartika, Khmer UI, KodchiangUPC, Kokila, Kristen ITC, Kunstler Script, Lao UI, Latha, Leelawadee, Levenim MT, LilyUPC, Lucida Bright, Lucida Calligraphy, Lucida Console, Lucida Fax, Lucida Handwriting, Lucida Sans, Lucida Sans Typewriter, Lucida Sans Unicode, Magneto, Maiandra GD, Mangal, Marlett, Matura MT Script Capitals, Microsoft Himalaya, Microsoft New Tai Lue, Microsoft PhagsPa, Microsoft Sans Serif, Microsoft Tai Le, Microsoft Uighur, Microsoft Yi Baiti, Miriam, Miriam Fixed, Mistral, Modern, Modern No. 20, Mongolian Baiti, Monotype Corsiva, MoolBoran, MS Outlook, MS Reference Sans Serif, MS Reference Specialty, MT Extra, MV Boli, Narkisim, Niagara Engraved, Niagara Solid, Nyala, OCR A Extended, OCRB, Old English Text MT, Onyx, Palace Script MT, Palatino Linotype, Papyrus, Parchment, Perpetua, Perpetua Titling MT, Plantagenet Cherokee, Playbill, Poor Richard, Pristina, Raavi, Rage Italic, Ravie, Rockwell, Rockwell Condensed, Rockwell Extra Bold, Rod, Roman, Sakkal Majalla, Script, Script MT Bold, Segoe Print, Segoe Script, Segoe UI, Segoe UI Light, Segoe UI Semibold, Segoe UI Symbol, Shonar Bangla, Showcard Gothic, Shruti, Simplified Arabic, Simplified Arabic Fixed, Snap ITC, Stencil, Sylfaen, Symbol, Tahoma, Tempus SansITC, Times New Roman, Traditional Arabic, Trebuchet MS, Tunga, Tw Cen MT, Tw Cen MT Condensed, Tw Cen MT Condensed Extra Bold, Utsaah, Vani, Verdana, Vijaya, Viner Hand ITC, Vivaldi, Vladimir Script, Vrinda, Webdings, Wide Latin, Wingdings, Wingdings 2, and Wingdings 3.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2015-191882 filed on Sep. 29, 2015, and 2015-244333 filed on Dec. 15, 2015, which are hereby incorporated by reference herein in their entirety.

What is claimed is:

1. A rotatable feeding member for feeding a recording material, comprising:

a surface layer formed of a resin material; and a character portion including characters selected from alphabetical and numeral characters made visible by recessing the surface layer, wherein the characters are arranged along a circumferential direction of the rotatable feeding member, and wherein the characters are slanted with respect to a longitudinal direction of the rotatable feeding member.

2. The rotatable feeding member according to claim 1, wherein an inclination angle of the slanted characters with respect to the longitudinal direction of the rotatable feeding member is 5° to 85°.

3. The rotatable feeding member according to claim 1, wherein the surface layer is formed of a fluorine-containing resin material.

4. The rotatable feeding member according to claim 1, wherein the surface layer has a surface resistivity of $10^{12}$ Ω/square or less.

5. A rotatable fixing member for fixing a toner image on a recording material, comprising:

a surface layer formed of a resin material; and a character portion including characters selected from alphabetical and numeral characters made visible by recessing the surface layer, wherein the characters are arranged along a circumferential direction of the rotatable fixing member, and wherein the characters are slanted with respect to a longitudinal direction of the rotatable fixing member.

6. The rotatable fixing member according to claim 5, wherein an inclination angle of the slanted characters with respect to the longitudinal direction of the rotatable fixing member is 5° to 85°.

7. The rotatable fixing member according to claim 5, wherein the surface layer is formed of a fluorine-containing resin material.

8. The rotatable fixing member according to claim 5, wherein the surface layer has a surface resistivity of $10^{12}$ Ω/square or less.

9. The rotatable feeding member according to claim 1, wherein an inclination angle of the slanted characters with respect to the longitudinal direction of the rotatable feeding member is 10° to 80°.

10. The rotatable fixing member according to claim 5, wherein an inclination angle of the slanted characters with respect to the longitudinal direction of the rotatable feeding member is 10° to 80°.

* * * * *